US012063987B2

(12) United States Patent
Carlino et al.

(10) Patent No.: US 12,063,987 B2
(45) **Date of Patent: *Aug. 20, 2024**

(54) MULTI-LAYER NURSING BRA AND NURSING BRA SYSTEM

(71) Applicant: Nike, Inc., Beaverton, OR (US)

(72) Inventors: Shannan C. Carlino, Portland, OR (US); Kristina E. Carter, Portland, OR (US); Karey B. Cruz, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/209,929

(22) Filed: Jun. 14, 2023

(65) Prior Publication Data

US 2023/0320435 A1 Oct. 12, 2023

Related U.S. Application Data

(63) Continuation of application No. 16/823,143, filed on Mar. 18, 2020, now Pat. No. 11,717,036.

(60) Provisional application No. 62/822,479, filed on Mar. 22, 2019.

(51) Int. Cl.
*A41C 3/04* (2006.01)
*A41C 5/00* (2006.01)

(52) U.S. Cl.
CPC . *A41C 3/04* (2013.01); *A41C 5/00* (2013.01)

(58) Field of Classification Search
CPC ..... A41C 3/04; A41C 5/00
See application file for complete search history.

(56) References Cited

U.S. PATENT DOCUMENTS

| | | | |
|---|---|---|---|
| 4,633,876 | A | 1/1987 | Scullin |
| 4,911,677 | A | 3/1990 | White |
| D475,835 | S | 6/2003 | Hoffman et al. |
| 7,077,720 | B2 | 7/2006 | Schneider et al. |

(Continued)

FOREIGN PATENT DOCUMENTS

| | | | |
|---|---|---|---|
| CA | 2559691 | A1 | 3/2008 |
| CN | 104273666 | A | 1/2015 |

(Continued)

OTHER PUBLICATIONS

"Serena Nursing Sports Bra", La Leche League International, Nursing Bras & Apparel, llibras.com, Accessed on Apr. 17, 2018, 7 pages.

"Fit Mama Nursing Sports Bra", Love and Fit, Available online at: <https://www.loveandfit.com/products/fit-mama-nursing-sports-bra>, Accessed on Nov. 23, 2018, 2 pages.

"Milx Nursing and Pumping Sports Bra", Milx, Available online at: <https://milx.mom/products/1-pack?variant=173772275738&currency=USD&utm_campaign=gs-2020-02-25&utm_source=google&utm_medium=smart_campaign&gclid=EAlalQobChMloaqn0sKf6AIVgsDACh1NIQJEEAQYASABEgKcV_D_BwE>, Accessed on May 20, 2020, 8 pages.

(Continued)

*Primary Examiner* — Gloria M Hale
(74) *Attorney, Agent, or Firm* — Shook, Hardy & Bacon L.L.P.

(57) ABSTRACT

Concepts provided are directed to a multi-layer nursing bra and a nursing bra system to be worn by a wearer. The multi-layer nursing bra includes an outer layer positioned over an inner layer. One or more edges of the outer layer and one or more edges of the inner layer may be manipulated to form an opening for breast feeding. The nursing bra system is composed of the multi-layer nursing bra and an upper-body garment configured to be layered over the multi-layer nursing bra. The upper-body garment includes a nursing opening on a front portion of the upper-body garment to provide access to the opening created in the multi-layer nursing bra when needed.

20 Claims, 15 Drawing Sheets

(56) References Cited

U.S. PATENT DOCUMENTS

| | | | | |
|---|---|---|---|---|
| D638,196 | S | 5/2011 | Torres | |
| 8,523,629 | B2 | 9/2013 | Pundyk | |
| D813,494 | S | 3/2018 | Betts | |
| 11,717,036 | B2 * | 8/2023 | Carlino | A41D 1/215 450/36 |
| 2005/0085160 | A1 | 4/2005 | Johnstone | |
| 2008/0022434 | A1 | 1/2008 | Adelman | |
| 2008/0064299 | A1 | 3/2008 | La | |
| 2009/0203295 | A1 | 8/2009 | Kassel | |
| 2010/0058512 | A1 | 3/2010 | Rothman | |
| 2012/0122370 | A1 | 5/2012 | Heath et al. | |
| 2016/0106159 | A1 | 4/2016 | Yau et al. | |
| 2017/0303606 | A1 | 10/2017 | Curry | |
| 2018/0000168 | A1 | 1/2018 | Alva | |
| 2018/0064177 | A1 | 3/2018 | Akerson et al. | |
| 2018/0092408 | A1 | 4/2018 | Hensel | |
| 2019/0000152 | A1 | 1/2019 | Fletcher | |
| 2020/0297042 | A1 | 9/2020 | Carlino et al. | |

FOREIGN PATENT DOCUMENTS

| | | | |
|---|---|---|---|
| CN | 204653830 | U | 9/2015 |
| CN | 107048493 | A | 8/2017 |
| CN | 108013515 | A | 5/2018 |
| DE | 102010020700 | A1 | 11/2011 |
| SI | 21217 | A | 12/2003 |
| WO | 2008/113867 | A1 | 9/2008 |
| WO | 2013/180644 | A1 | 12/2013 |

OTHER PUBLICATIONS

"Plus Size Wrap Maternity And Nursing Sleep Bra", Motherhood Maternity, <https://www.motherhood.com/plus-size-wrap-nursing-sleep-bra/001-92230-000-001.html?dwvar_001-92230-000-001_color=006-92230-35&cgid=nursing-,bras#mrkgcl=917&mrkgadid=1611566418&creative=405806498316&device=c&matchtype=p&network=g&gclsrc=aw.ds&gclid=EAlalQobChMIjr23xsGf6AIVwcDACh118QXSEAAYASAAEgKFWPD_BwE&start=1>, Accessed on May 20, 2020, 7 pages.

"Wire Free Sport Nursing Bra", Wacoal, wacoal-america.com, Accessed on Jan. 4, 2018, 2 pages.

"Clothing Craft" is blinded by Douyin! There has always been a misunderstanding of the invisible needle method!, Available online at <https://www.bilibili.com/video/BV15W411179Y/?spm_id_fro>, Oct. 8, 2018, 2 pages.

International Preliminary Report on Patentability received for PCT Patent Application No. PCT/US2020/023756, dated Oct. 7, 2021, 9 pages.

International Search Report and Written Opinion dated Jun. 8, 2020 in International Patent Application No. PCT/US2020/023756, 18 pages.

Office Action received for Canadian Patent Application No. 3,134,037, dated Dec. 8, 2022, 3 pages.

Office Action received for European Patent Application No. 20719020.8, dated Mar. 5, 2024, 5 pages.

* cited by examiner

MULTI-LAYER NURSING BRA AND NURSING BRA SYSTEM

CROSS-REFERENCE TO RELATED APPLICATIONS

This application is a continuation of U.S. Non-Provisional application Ser. No. 16/823,143 (filed on Mar. 18, 2020), now U.S. Pat. No. 11,717,036 (issued on Aug. 8, 2023), which in turn claims the benefit of priority of U.S. Provisional Application No. 62/822,479 (filed on Mar. 22, 2019. Each of the aforementioned applications is incorporated by reference herein in its entirety.

TECHNICAL FIELD

Aspects herein relate to a multi-layer nursing bra and a nursing bra system.

BACKGROUND

Traditionally, nursing bras comprise openable cup portions that are held closed by clasps. The nursing bras may be worn under upper-body garments or other nursing garments, however, due to the clasping system, traditional nursing bras may be hard to operate single handedly, or the clasps may be prone to getting stuck, or cause discomfort by creating undesirable pressure points. In addition, the upper-body garment that is worn over the nursing bra may need to be pulled upward from its bottom hem to expose the nursing bra which may present modesty concerns.

BRIEF DESCRIPTION OF THE SEVERAL VIEWS OF THE DRAWINGS

The present invention is described in detail below with reference to the attached drawing figures, wherein.

DETAILED DESCRIPTION

Figure 1:
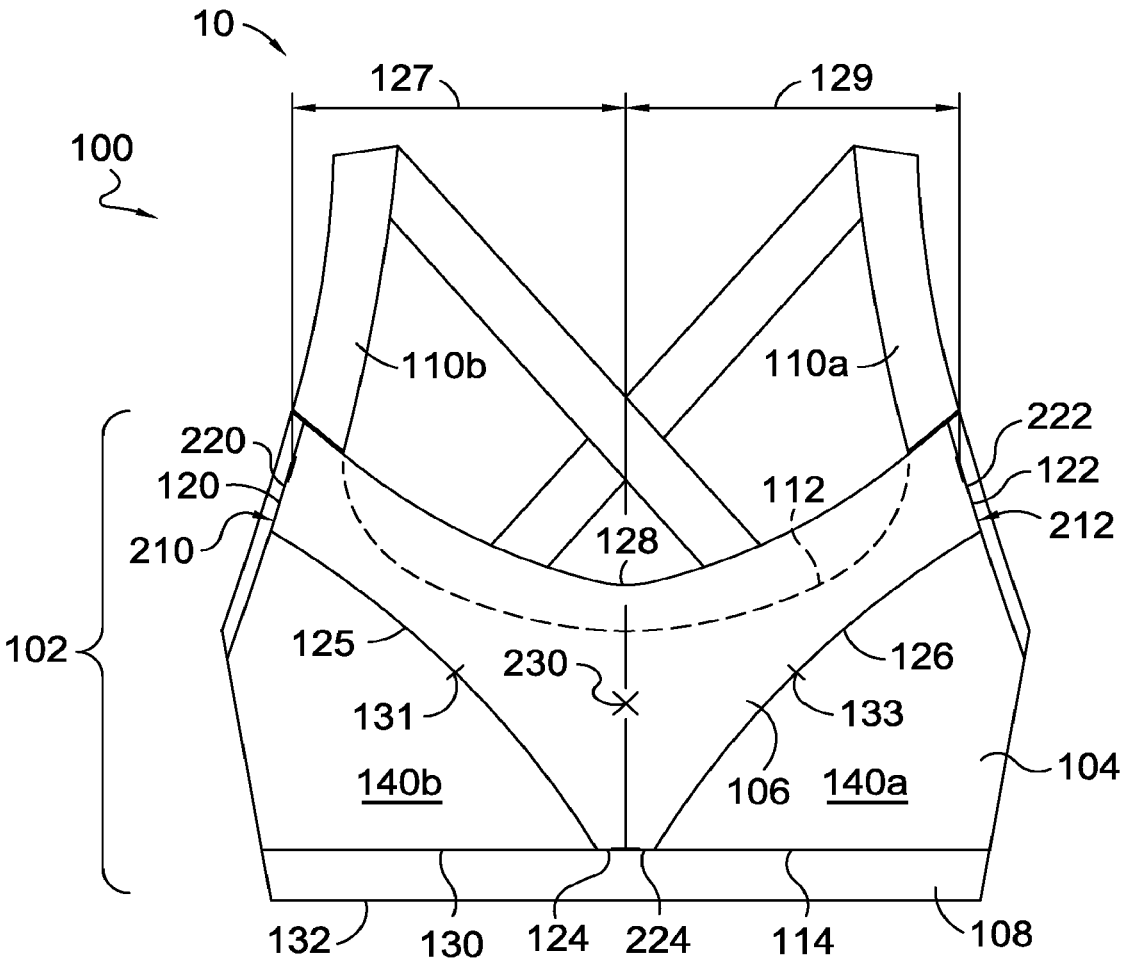
FIG. 1 illustrates a front view of a first example multi-layer nursing bra in a "closed" first state, in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Nursing bras and garments, particularly those for use in the postpartum period, are often complex and cumbersome, having bulky components that are difficult to use and uncomfortable for the wearer. Further, nursing garments are often not made for active women, forcing active women to sacrifice functionality for comfort and vice versa. Some women choose to sacrifice exercise altogether during pregnancy and/or post-pregnancy because of a lack of functional and comfortable athletic wear. The multi-layer nursing bra and multi-layer nursing bra system disclosed herein allow a wearer to easily access one or more breasts when engaging in activities such as, for example, nursing and/or pumping, while also eliminating bulky components such as clasps and wires. Thus, the wearer can more easily transition from exercise and other day-to-day activities to nursing and/or pumping without sacrificing comfort and overall functionality of the garments.

At a high level, aspects herein are generally directed to a multi-layer nursing bra and a multi-layer nursing bra system having various elements that contribute to the operation of the multi-layer nursing bra and multi-layer nursing bra system, both independently of, and in combination with, one another. For example, the multi-layer nursing bra generally includes an inner layer and an outer layer positioned over the inner layer. In some instances, one of the inner or outer layers may be substantially Y-shaped or substantially triangular shaped, as will be described herein. Various aspects of the inner and outer layers of the multi-layer nursing bra are movable with respect to one another to allow for easy exposure of one or more breasts and/or nipple area of the wearer. The multi-layer nursing bra system generally includes the multi-layer nursing bra and an upper-body garment layered over the multi-layer nursing bra. The upper-body garment generally includes a nursing opening that is movable between a closed state and an open state for easy access to the multi-layer nursing bra and one or more breasts of the wearer.

In one example, the multi-layer nursing bra includes a front portion having an inner layer (also referred to as a first textile layer) and an outer layer (also referred to as a Y-shaped outer layer, or a second textile layer). The inner layer extends between an upper edge (also referred to as a first superior edge) and a lower edge (also referred to as a first inferior edge). The outer layer covers at least a portion of the inner layer and comprises a right edge (also referred to as a first side edge) extending between an upper right portion (also referred to as a first superior terminal end) and a lower central portion (also referred to as a third inferior terminal end), a left edge (also referred to as a second side edge) extending between an upper left portion (also referred to as a second superior terminal end) and the lower central portion, and an upper edge (also referred to as second superior edge) extending between the upper right portion and the upper left portion. In some instances, the right edge and the left edge converge as they extend toward the lower central portion of the outer layer. The right edge and the left edge of the outer layer are both moveable relative to the inner layer along at least a midpoint of the right edge and along at least a midpoint of the left edge of the outer layer. In some instances, the multi-layer nursing bra also includes an underband that extends from the lower edge of the inner layer. The underband may be integral with the inner layer or may otherwise be attached thereto. Further, when the underband is provided, the lower central portion of the outer layer is secured to a central region of the underband (also referred to as a mid-area of the underband).

In another example, the multi-layer nursing bra includes a front portion having an inner layer and an outer layer. The inner layer has a right edge extending between an upper right portion and a lower central portion of the inner layer, a left edge extending between an upper left portion and the lower central portion of the inner layer, and an upper edge extending between the upper right portion and the upper left portion. In some instances, the right edge and the left edge converge as they extend toward the lower central portion of the inner layer. The outer layer is a cross-over or wrap style layer having a right-side outer layer and a left-side outer layer, in which a medial portion of the right-side outer layer and a medial portion of the left-side outer layer overlap at a central region of the front portion. The right-side outer layer has a right-side upper edge and a right-side lower edge, and the left-side outer layer has a left-side upper edge and a left-side lower edge. The right-side upper edge of the right-side outer layer and the left-side upper edge of the left-side outer layer are both moveable relative to the inner layer along at least a midpoint of the right edge and along at least a midpoint of the left edge of the inner layer.

Optionally, the multi-layer nursing bra may also include a back portion that continuously extends from the front portion. Alternatively, in some instances, the multi-layer nursing bra can include a right wing band (also referred to as a first wing band) extending from the right side (also referred to as a first lateral side) of the front portion and a left wing band (also referred to as a second wing band) extending from the right side (also referred to as the second lateral side) of the front portion. In some examples, the right wing band includes a first component of an adjustable closure mechanism and the left wing band includes a second component of the adjustable closure mechanism. In operation, the first and second components of the adjustable closure mechanism may be releasably coupled to each other.

Aspects herein are also directed to a method for manufacturing the multi-layer nursing bra. The method includes forming the front portion of the multi-layer nursing bra by positioning the outer layer over the inner layer, where the inner surface of the outer layer is positioned adjacent to or overlies at least a portion of the outer surface of the inner layer. In some instances, this step is followed by, for example, affixing the lower central portion of the outer layer to a lower central portion of the inner layer. In other instances, the lower central portion of the outer layer is affixed to a discrete area of the underband, which is optionally affixed along a length of the lower edge of the inner layer. In yet other instances, the underband may be integral with the inner layer. By "integral," it is to be understood that the underband is formed with the inner layer in a single textile forming event such as, for example, knitting, weaving, braiding, and the like. In other words, when the underband is integral with the inner layer, the underband seamlessly and continuously extends from the inner layer and does not need to be attached to the inner layer by stitching, bonding, and the like. In instances where the multi-layer nursing bra includes a back portion and/or wing bands, the underband may also be integral with the back portion and/or the wing bands.

Additionally, aspects herein are also directed to a multi-layer nursing bra system comprised of the multi-layer nursing bra and an upper-body garment. The multi-layer nursing bra may be constructed as described above and may be configured to be worn under the upper-body garment. In some instances, the upper-body garment includes a front portion and a back portion defining at least a neck opening and a torso opening. In example aspects, the front portion is measured from a first side seam to a second side seam. The first side seam generally extends from an inferior edge of a right arm or sleeve opening of the upper-body garment to the torso opening of the upper-body garment. The second side seam generally extends from an inferior edge of a left arm or sleeve opening of the upper-body garment to the torso opening of the upper-body garment. When the upper-body garment comprises a seamless construction (i.e., there are no side seams, or seams affixing or attaching the front portion to the back portion), the front portion is measured from a first location adjacent to the inferior edge of the right arm or sleeve opening to a second location adjacent to the inferior edge of the left arm or sleeve opening.

As described above, in some instances, the upper body garment includes a nursing opening. The nursing opening is positioned on the front portion of the upper body garment below a front edge defining the neck opening. The nursing opening substantially extends across the width of the front portion between a first lateral side of the front portion at or near the first side seam to a second lateral side of the front portion at or near the second side seam. In accordance with aspects herein, the term "substantially" when used to describe the nursing opening means that the nursing opening horizontally extends (i.e., orthogonal to a head-to-toe axis of a wearer) at least about 65% of the width of the front aspect, at least about 70% of the width of the front aspect, at least about 75% of the width of the front aspect, at least about 80% of the width of the front aspect, at least about 85% of the width of the front aspect, at least about 90% of the front aspect, or at least about 95% of the front aspect. As used herein, the term "about" means within ±5% of a designated value. The nursing opening in accordance with aspects herein may also be defined by an upper perimeter edge and a lower perimeter edge that may be overlapped when the nursing opening is in a closed state or first state.

Further, aspects herein are also directed to a method of using the multi-layer nursing bra system described above. For example, the wearer may first don the multi-layer nursing bra over an upper torso area of the wearer such that the front portion of the multi-layer nursing bra is positioned over the wearer's bust for providing support, as will become more apparent with respect to the figures. The upper-body garment can then be donned over the multi-layer nursing bra such that the nursing opening of the upper-body garment is radially aligned with the front portion of the multi-layer nursing bra.

As briefly described above, the positioning of the multi-layer nursing bra and the upper-body garment is advantageous because it provides easy access to the breast area of the wearer and may provide more modesty than many conventional maternity and/or nursing garments. For instance, instead of the wearer having to pull up the bottom hem of the upper-body garment to access the opening in the multi-layer nursing bra, the wearer can utilize the nursing opening of the upper-body garment. This may not only be more comfortable, but it may also allow for a more modest breast feeding experience for the wearer. Thus, the multi-layer nursing bra system described herein provides both a functional and comfortable multi-layer nursing bra and upper-body garment to the wearer.

Unless indicated otherwise, all measurements provided herein are taken when the bra and/or garment is at standard ambient temperature and pressure (298.15 K and 100 kPa) and the bra and/or garment is in a resting state (e.g., an unstretched state).

FIG. 1 is a front view 10 of an example multi-layer nursing bra 100 in a closed state. As shown, the multi-layer nursing bra 100 comprises a front portion 102 including an inner layer 104 and an outer layer 106. As shown, the outer layer 106 is overlying or positioned adjacent to the inner layer 104, as will become more apparent with respect to FIG. 2. As shown in FIG. 1, the inner layer 104 has an upper edge 112, a lower edge 114, a right side edge 210, and a left side edge 212. The outer layer 106 has an upper right portion 120, an upper left portion 122, and a lower central portion 124 that are positioned so that the outer layer 106 forms a substantially upright "Y-shape" or a triangular shape and, in particular, an upside down triangular shape (i.e., a triangular shape having the base positioned superior to the apex) with the upper right portion 120 and the upper left portion 122 located above the lower central portion 124. As used herein, the term substantially upright Y-shape means a shape corresponding generally to the letter "Y" and having two upright arms and a stem. It is not meant to imply any specific characteristics of the edges extending between the upright arms and the stem. The outer layer 106 has an upper edge 128 that extends between the upper right portion 120 and the upper left portion 122, a right edge 125 that extends between the upper right portion 120 and the lower central portion 124 having a midpoint 131, and a left edge 126 that extends between the upper left portion 122 and the lower central portion 124 having a midpoint 133. The upper edge 128 of the outer layer 106 is generally located above the upper edge 112 of the inner layer 104. In accordance with aspects herein, the right edge 125, the left edge 126, and/or the upper edge 128 of the outer layer 106 are curved inwardly with respect to a central area 230 of the outer layer 106. However, in other aspects, one or more of the right edge 125, the left edge 126, and/or the upper edge 128 of the outer layer 106 may be curved outwardly with respect to the central area 230 and/or may be substantially straight.

Further, in some instances, the right edge 125, the left edge 126, and/or the upper edge 128 of the outer layer 106 are substantially detached from or not seamed to the inner layer 104. In accordance with aspects herein, "substantially," describes that at least about 70% of the right edge 125, the left edge 126, and/or the upper edge 128 of the outer layer 106 are detached or "free" from the inner layer 104, at least about 75% of the right edge 125, the left edge 126, and/or the upper edge 128 of the outer layer 106 are detached or "free" from the inner layer 104, at least about 80% of the right edge 125, the left edge 126 and/or the upper edge 128 of the outer layer 106 are detached or "free" from the inner layer 104, at least about 85% of the right edge 125, the left edge 126 and/or the upper edge 128 of the outer layer are detached or "free" from the inner layer 104, or at least about 90% of the right edge 125, the left edge 126 and/or the upper edge 128 of the outer layer 106 are detached or "free" from the inner layer 104. As used herein, the term "about" means within ±10% of a reference value. Because at least the right edge 125 and the left edge 126 of the outer layer 106 are substantially detached from the inner layer 104, at least a midpoint 131 of the right edge 125 and at least a midpoint 133 of the left edge 126 can be independently manipulated or moved with respect to the inner layer 104. In some instances, the upper edge 112 of the inner layer 104 is also substantially detached from the outer layer 106 and thus, can also be independently manipulated or moved with respect to the outer layer 106. This, in turn, allows the wearer to easily expose one or more breast by manipulating the inner layer 104 and the outer layer 106.

Because of the dynamic nature of the multi-layer nursing bra 100, it is contemplated that the inner layer 104 and the outer layer 106 of the multi-layer nursing bra 100 may both be comprised of elastically resilient textile materials that may be woven, knit, braided, or otherwise formed, such as for example double knit, warp knit mesh, jersey knit, and the like. The base materials forming the elastically resilient textiles may include, for example, recycled polyester, elastomeric yarns (e.g. spandex), and the like. In accordance with certain aspects, the outer layer 106 and the inner layer 104 of the multi-layer nursing bra 100 may be comprised of the same textile material. In accordance with other aspects, the outer layer 106 and the inner layer 104 of the multi-layer nursing bra 100 may be comprised of different textile materials having substantially the same elasticity, or in other words, the inner layer 104 and the outer layer 106 may have equal moduli of elasticity. In yet other aspects, the outer layer 106 and the inner layer 104 of the multi-layer nursing bra 100 may be comprised of different textile materials having different elasticity properties, or in other words, the modulus of elasticity of the inner layer 104 may be different from the modulus of elasticity of the outer layer 106. As well, the inner layer 104, or both the inner layer 104 and the outer layer 106 may have moisture management properties, anti-bacterial properties, odor resistant properties, and the like. With respect to moisture-management properties, these may be imparted by, for example, utilizing a denier differential mechanism, a chemical treatment, and the like.

Figure 7:
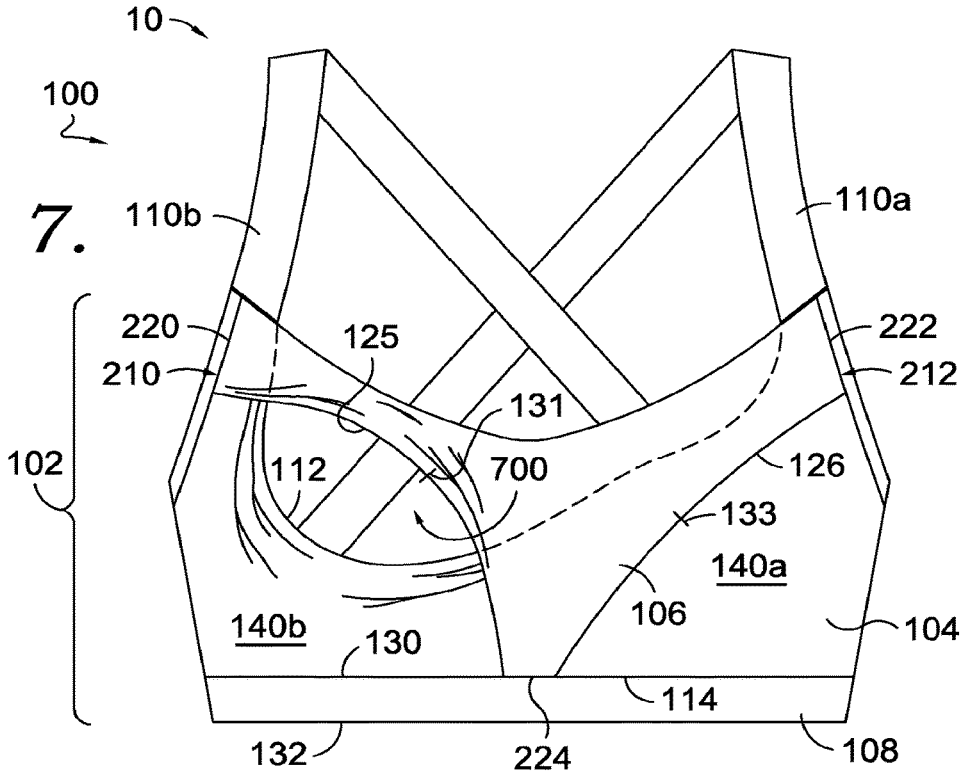

The multi-layer nursing bra can be in a closed state as shown in FIG. 1, or in an open state as shown in FIG. 7. In the closed state as shown in FIG. 1, the right edge 125 and the left edge 126 of the outer layer 106 are positioned below the upper edge 112 of the inner layer 104, as shown by the dashed line to indicate that it is generally hidden from view in the closed state.

Figure 4A:
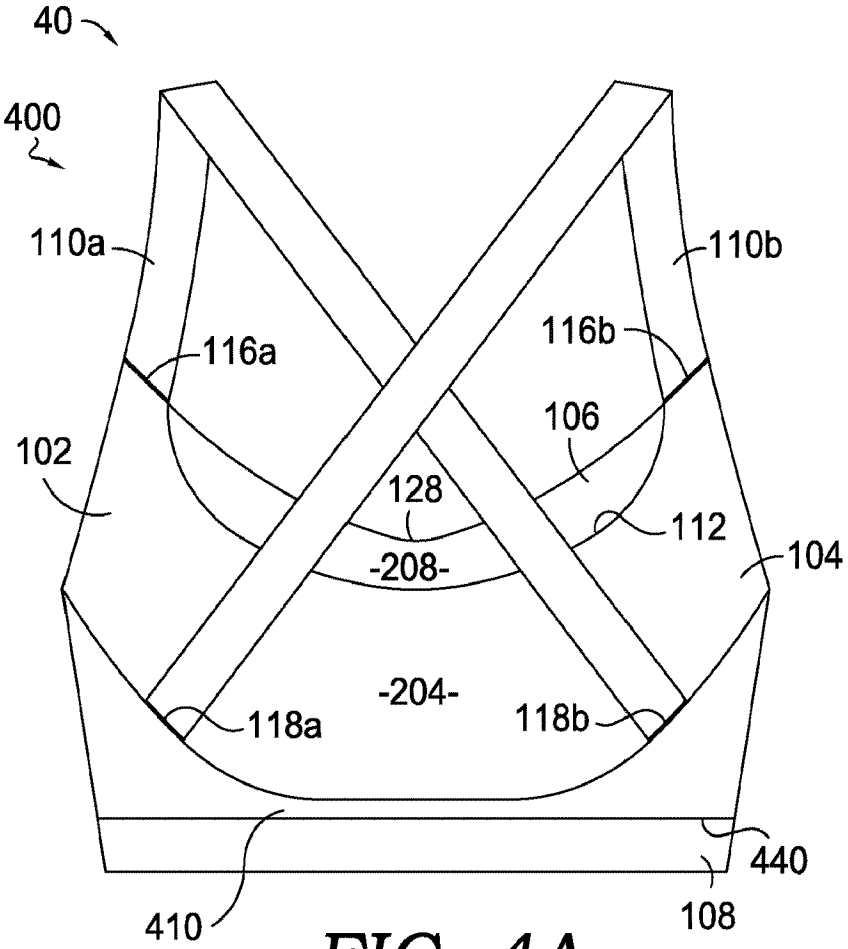
FIGS. 4A and 4B illustrate back portions of two example multi-layer nursing bras in accordance with aspects herein.
Figure 4B:
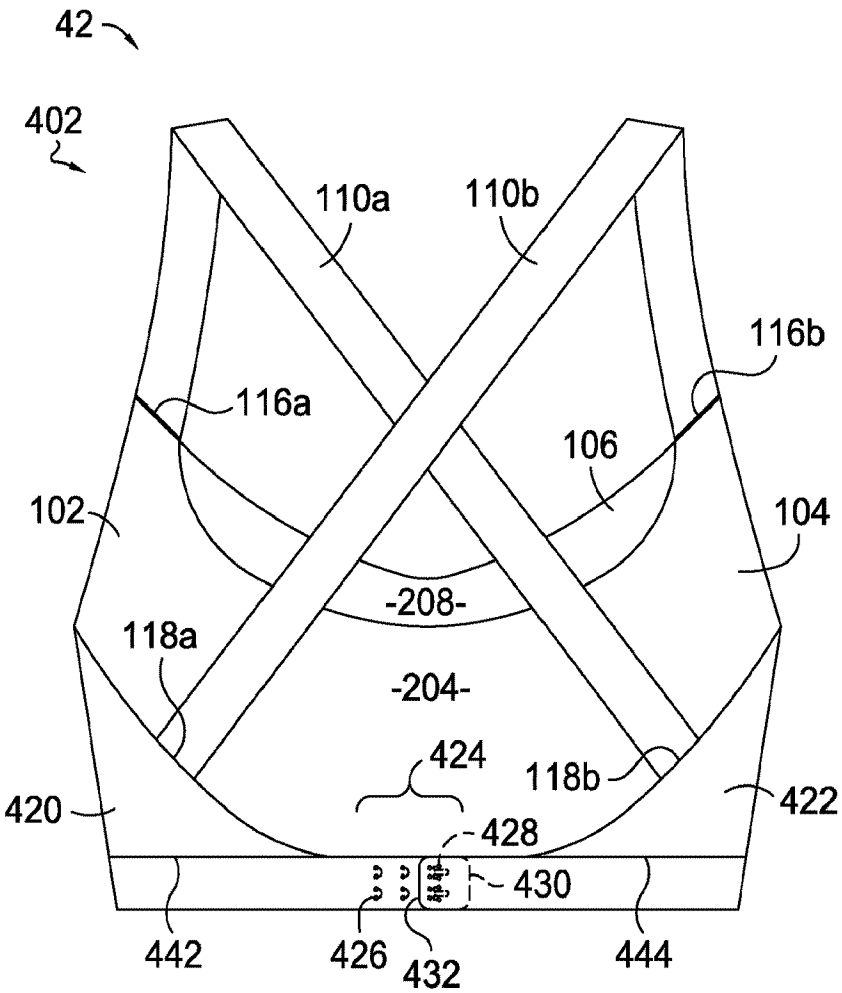

In some instances, the multi-layer nursing bra 100 also includes an underband 108 having an upper edge 130 and a lower edge 132. Thus, when assembled, the outer layer 106 may be secured by sewing, bonding, or other affixing technologies to the inner layer 104 by affixing the upper right portion 120 of the outer layer 106 to a portion 220 of the right side edge 210 of the inner layer 104 and affixing the upper left portion 122 of the outer layer 106 to a portion 222 of the left side edge 212 of the inner layer 104. Similarly, the upper edge 130 of the underband 108 may be secured to the lower edge 114 of the inner layer 104 along a length of the lower edge 114 of the inner layer 104. In some instances, the underband 108 extends at least along the lower edge 114 of the front portion 102. In instances where a back portion 410 continuously extends from the inner layer 104 of the front portion 102, as shown in FIG. 4A, for example, the underband 108 continuously extends along an inferior edge of the back portion 410. Alternatively, if the back portion is comprised of a right wing band 422 and a left wing band 420, as shown in FIG. 4B, for example, the underband 108 continuously extends from the front portion 102 to a first end of the right wing band 422 along an inferior edge of right wing band 422, and from the front portion 102 to a second end of the left wing band 420 along an inferior edge of left wing band 420. In other words, the underband 108 may circumferentially extend around the inferior edge(s) of the front portion 102 and the back portion 410 and/or right wing band 422 and left wing band 420.

The lower central portion 124 of the outer layer 106 may also be secured to the upper edge 130 of the underband 108 at a mid-area 224 of the underband 108. The lower central portion 124 of the outer layer 106 is generally equidistant along a horizontal axis between the upper right portion 120 and the upper left portion 122. Consequently, the mid-area 224 of the underband 108 to which the outer layer 106 is affixed by way of the lower central portion 124, is generally equidistant along the horizontal axis between the upper right portion 120 and the upper left portion 122. In other words, the mid-area 224 is generally equidistant from the portion 220 of the right side edge 210 and the portion 222 of the left side edge 212 of the inner layer 104. As shown in FIG. 1, a distance 127 measured from the portion 220 to a perpendicular line extending from the mid-area 224 of the underband 108 is substantially equal to a distance 129 measured from the portion 222 to the perpendicular line extending from the mid-area 224. The term "substantially equal" when used to describe distance and/or length in accordance with aspects herein means that at least two measured distances and/or lengths are at least about 90% the same, or that the distances and/or lengths are at least about 95% the same, or that the distances and/or lengths are at least about 98% the same.

As shown in FIG. 1, the multi-layer nursing bra 100 may also optionally comprise a first shoulder strap 110*a* and a second shoulder strap 110*b*. Although the first and second shoulder straps 110*a* and 110*b* are depicted as having a crisscross configuration in the back of the multi-layer nursing bra 100, it is contemplated that the first and second shoulder straps 110*a* and 110*b* may have other configurations such as, for example, parallel or T-shape. In other instances, the multi-layer nursing bra 100 may include only one strap such as in a halter-type configuration or may include no straps such as in a strapless configuration without departing from the aspects disclosed herein.

Figure 2:
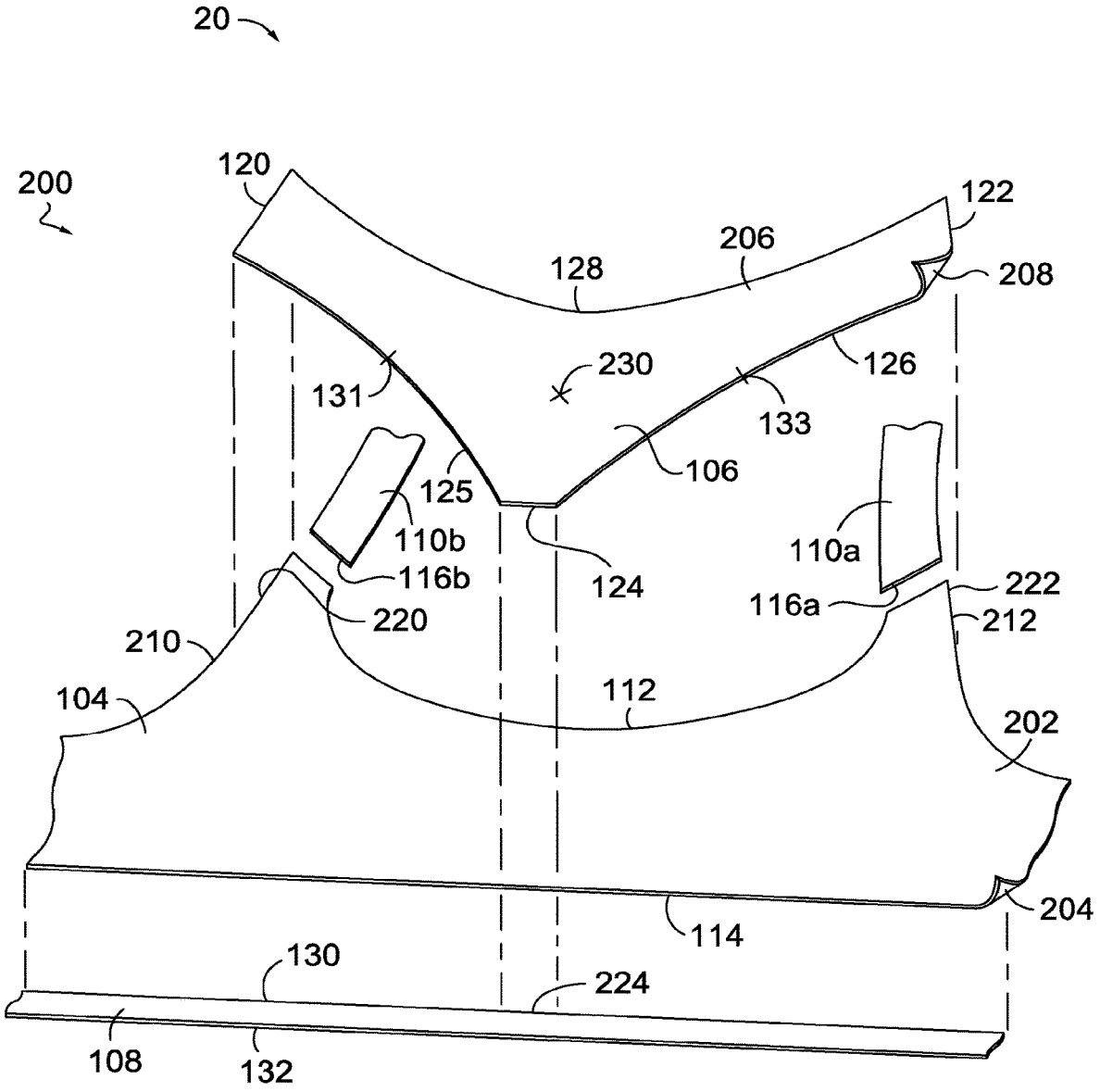
FIG. 2 illustrates a deconstructed view of a front portion of the multi-layer nursing bra shown in FIG. 1 in accordance with aspects herein.

FIG. 2 shows a deconstructed view 20 of the front portion 102 of the multi-layer nursing bra 100. As shown in FIG. 2, the inner layer 104 has a first or outer surface 202 and a second or inner surface 204 opposite the outer surface 202. Similarly, the outer layer 106 has a first or outer surface 206 and a second or inner surface 208 opposite the outer surface 206. When the outer layer 106 is overlying or positioned on top of the inner layer 104, the inner surface 208 of the outer layer 106 is positioned adjacent to the outer surface 202 of the inner layer 104. As shown in FIG. 1, portions 140*a* and 140*b* of the outer surface 202 of the inner layer 104 are not covered by the outer layer 106 when the outer layer 106 is layered on top of the inner layer 104.

Figure 3:
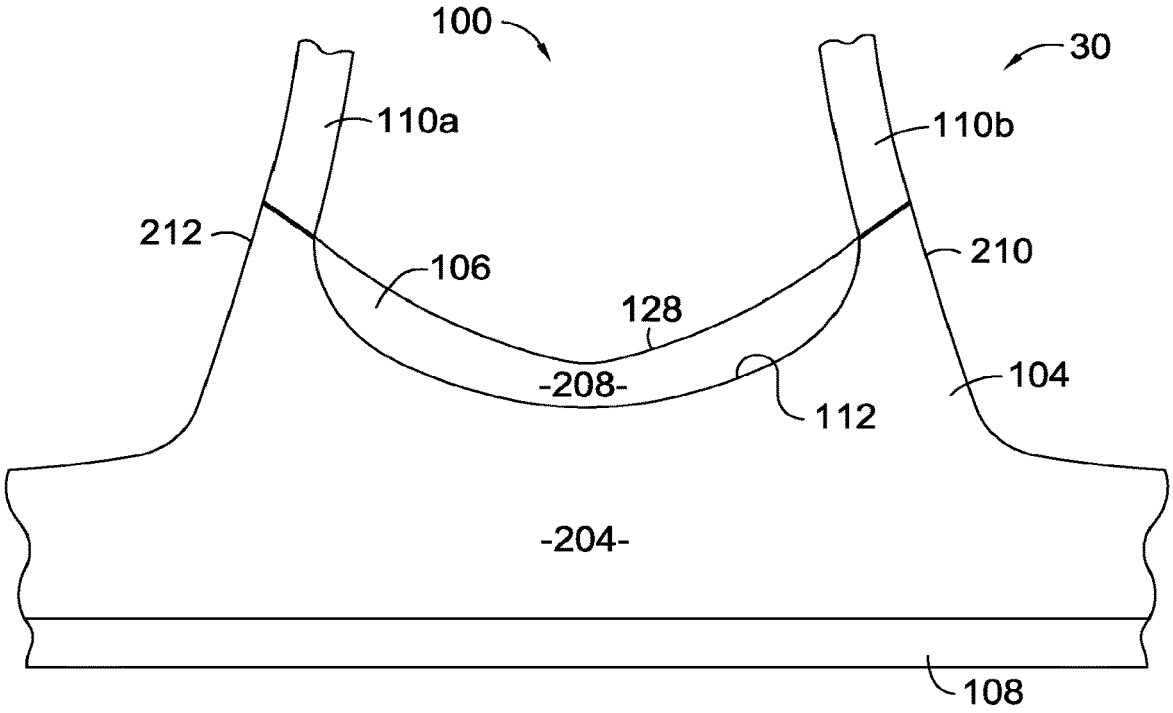
FIG. 3 illustrates an interior view of the front portion of the multi-layer nursing bra shown in FIG. 1, in accordance with aspects herein.

FIG. 3 shows an interior view 30 of the multi-layer nursing bra 100. As shown, the inner surface 204 of the inner layer 104 and a portion of the inner surface 208 of the outer layer 106 are configured to face a wearer when the multi-layer nursing bra 100 is worn. A seamless surface such as the inner surface 204 of the inner layer 104 that is in direct contact with the wearer's skin may improve comfort by eliminating pressure points that may be caused by seams or clasps. The seamless surface may also provide support to the bust area of the wearer when the multi-layer nursing bra 100 is worn, which can be seen from the lateral view 50 of the multi-layer nursing bra 100 shown in FIG. 5. In some instances, such as when additional protection is desired, the inner layer 104 may include one or more pad pockets configured to align with a breast area of the wearer when then multi-layer nursing bra 100 is worn by the wearer. Each of the one or more pad pockets is configured to accommodate, for example, nursing pads or modesty pads for covering the nipples of the wearer and/or absorbing any milk leakage, breast enhancement inserts, and the like. Alternatively or additionally, the inner layer 104 may comprise a spacer material that is positioned to align with, for instance, the portion of a wearer's breast surrounding the nipple to provide modesty, breast enhancement, and/or to absorb moisture resulting from sweat from exercise and/or milk leakage during nursing.

FIGS. 4A and 4B depict rear views 40 and 42 respectively of two example multi-layer nursing bra configurations. For example, FIG. 4A depicts a rear view 40 of a multi-layer nursing bra 400 having a single piece back portion 410 extending from the front portion 102, or the inner layer 104 of the front portion 102. FIG. 4B depicts a rear view 42 of a multi-layer nursing bra 402 having a left wing band 420 extending from a left side of the front portion 102, or the left side of the inner layer 104 of the front portion 102, and a right wing band 422 extending from the right side of the front portion 102, or the right side of the inner layer 104 of the front portion 102.

Figure 5:
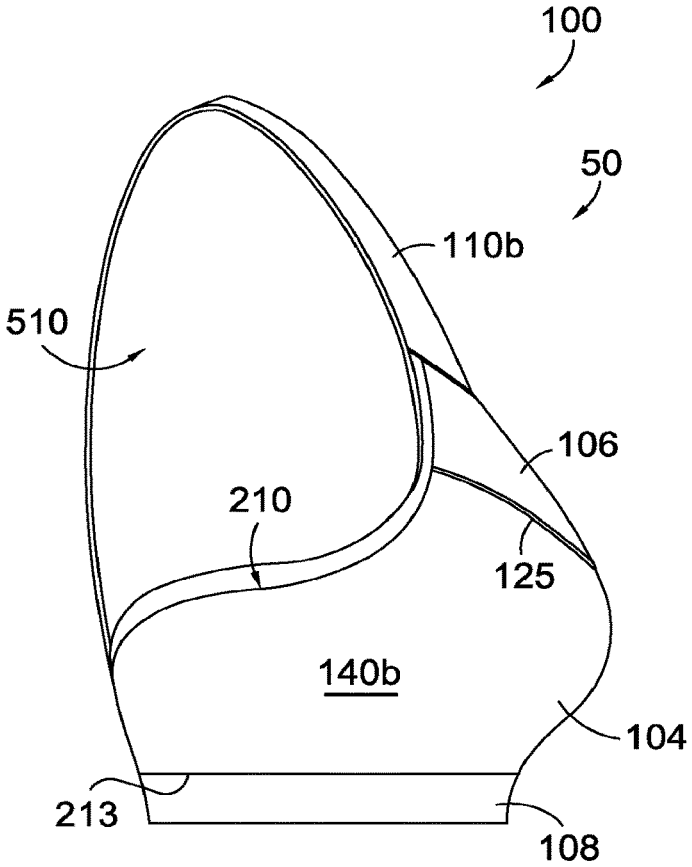
FIG. 5 illustrates a side view of the multi-layer nursing bra shown in FIG. 1, in accordance with aspects herein.

It is contemplated that in either multi-layer nursing bra configuration, the front portion 102 of the multi-layer nursing bras 400 and 402 will cooperate with the back portion 410, or the left wing band 420 and the right wing band 422, respectively, to define the right side edge 210 and the left side edge 212. The right side edge 210 and the left side edge 212 define underarm perimeter portions that are configured to extend along an underarm portion of a wearer, as shown in FIGS. 1 and 5, when the multi-layer nursing bras 100, 400, or 402 are in their as-worn configurations. Further, as shown in FIG. 4A, the underband 108, may extend from the front portion 102 to the back portion 410 and may be attached at underband edge 440 of the back portion 410. Alternatively, as shown in FIG. 4B, the underband 108 may extend from a left side of the front portion 102 to a first end 430 of the left wing band 420 and is attached to the left wing band 420 at underband edge 442. Similarly, the underband 108 may extend from a right side of the front portion 102 to a second end 432 of the right wing band 422 and is attached to the right wing band 422 at underband edge 444 of the right wing band 422.

In some instances, each of the left wing band 420 and the right wing band 422 of multi-layer nursing bra 402 may comprise a respective component of an adjustable closure mechanism 424. For example, the first end 430 of the left wing band 420 may comprise a first component(s) 426 of the adjustable closure mechanism 424, and the second end 432 of the right wing band 422 may comprise a second component(s) 428 of the adjustable closure mechanism 424, in which the first component 426 is adapted to be releasably coupled to the second component 428. Further, as shown, each of the first and second shoulder straps 110*a* and 110*b* may comprise a first end 116*a* and 116*b*, respectively, coupled to or extending from the front portion 102 of the multi-layer nursing bras 100, 400, and 402, as described above. Each of the first and second shoulder straps 110*a* and 110*b* also include a second end 118*a* and 118*b*, respectively, coupled to or extending from the back portion 410 of the multi-layer nursing bra 400, as shown in FIG. 4A, or the respective left and right wing bands 420 and 422 of the multi-layer nursing bra 402, as shown in FIG. 4B.

In some instances, the multi-layer nursing bra 400 may be donned by pulling the multi-layer nursing bra 400 from the shoulders downward onto the upper torso area of the wearer, as is done with conventional sport bras. On the other hand, the multi-layer nursing bra 402 may be donned by opening the adjustable closure mechanism 424, positioning the front portion 102 of the multi-layer nursing bra 402 over the bust area of the wearer, wrapping the left and right wing bands 420 and 422 around the upper torso of the wearer, and affixing the first and second ends 430 and 432 of the left and right wing bands 420 and 422 to each other by releasably engaging the first and second components 426 and 428 of the adjustable closure mechanism 424.

As shown in FIG. 5, the first and second shoulder straps 110*a* and 110*b* in combination with the right side edge 210 and left side edge 212 of the inner layer 104, may form in part arm openings 510 through which the wearer may extend her arms when wearing one of the multi-layer nursing bras 100, 400, or 402 in accordance with aspects herein. Further, it is contemplated that, regardless of whether the back portion 410 is provided as a single piece, as shown in FIG. 4A, or as left and right wing bands 420 and 422, as shown in FIG. 4B, the back portion 410 or the left and right wing bands 420 and 422, may be coupled to the inner layer 104 by attachment means such as stitching, bonding, and the like. Alternatively, the back portion 410 or the left and right wing bands 420 and 422 may seamlessly and continuously extend from the inner layer 104, as a single piece. As shown in FIG. 5, the underband 108 may be continuously affixed/attached to an underband edge 213 of the back portion 410, as shown in FIG. 4A, or the left and right wing bands 420 and 422, as shown in FIG. 4B. In accordance with aspects herein, "seamlessly and continuously extend(s)" infers that there are no attachment means (i.e., no seam lines) because the inner layer 104 and the back portion 410, or the left and right wing bands 420 and 422, are formed from a single piece of material.

In another example, in accordance with aspects herein the inner layer 104 seamlessly and continuously extends between the right side edge 210 and the left side edge 212, and the outer layer 106 seamlessly and continuously extends between the right edge 125 and the left edge 126. To describe this differently, the inner layer 104 and the outer layer 106 may each be formed from a single piece of material void of any seams or attachment means that connect two or more pieces of material together. The term "seamlessly and continuously extend(s)" also encompasses situations where one or more of the inner layer 104, the outer layer 106, the back portion 410, or the left and right wing bands 420 and 422 may optionally be provided with slits, holes, perforations, and the like to provide, for example, increased breathability and/or aesthetic appeal to the garment. In some instances, the inner layer 104, the outer layer 106, the back portion 410, and/or the left and right wing bands 420 and 422 may be comprised of a mesh type material and/or may comprise moisture management properties to improve comfort. This may be especially helpful when the wearer is exercising or performing other physically demanding tasks that increase the wearer's body temperature.

Figure 6:
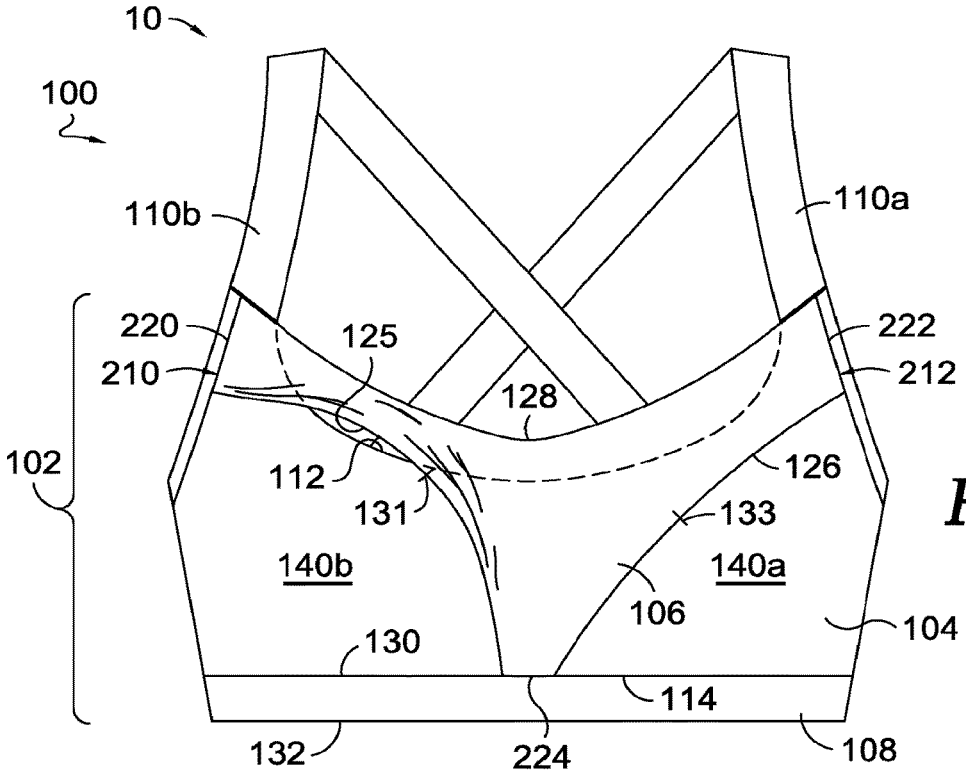
FIGS. 6 and 7 illustrate the multi-layer nursing bra shown in FIG. 1 as it is being transitioned to an "open" second state, in accordance with aspects herein.

FIGS. 6 and 7 depict the multi-layer nursing bra 100 transitioning from the closed state to an open state. Initially, as shown in FIG. 6, in order to open a right side of the multi-layer nursing bra 100, an upward force is exerted on at least the midpoint 131 of the right edge 125 of the outer layer 106, thereby exposing at least a portion of the upper edge 112 of the inner layer 104. Once the upper edge 112 of the inner layer 104 is exposed, a downward force is exerted on at least the exposed portion of the upper edge 112 of the inner layer 104 to form an opening 700. When the opening 700 is formed, at least a portion of the right edge 125 of the outer layer 106 is positioned above at least a portion of the upper edge 112 of the inner layer 104. In other words, the opening 700 is between at least one of the right edge 125 or the left edge 126 of the outer layer 106 and the upper edge 112 of the inner layer 104. The opening 700 provides access to the nipple area of the wearer for breast feeding or pumping, for example. This arrangement offers several advantages such as, for example, eliminating the need for hard-to-manipulate clasps and uncomfortable pressure points resulting from the clasps, and allowing for easy manipulation, particularly single-handed manipulation, of the multi-layer nursing bra 100.

Once the breast feeding or pumping is completed, the multi-layer nursing bra 100 may be returned to the closed state by exerting an upward force on the upper edge 112 of the inner layer 104 and exerting a downward force on the right edge 125 of the outer layer 106, where the right edge 125 of the outer layer 106 is positioned below the upper edge 112 of the inner layer 104 when the opening 700 is closed. Similarly, for the left side, an upward force may be exerted on at least the midpoint 133 of the left edge 126 of the outer layer 106, thereby exposing at least a portion of the upper edge 112 of the inner layer 104, to form an opening, and closing the opening in a similar manner as described above for the right side.

Figure 8:
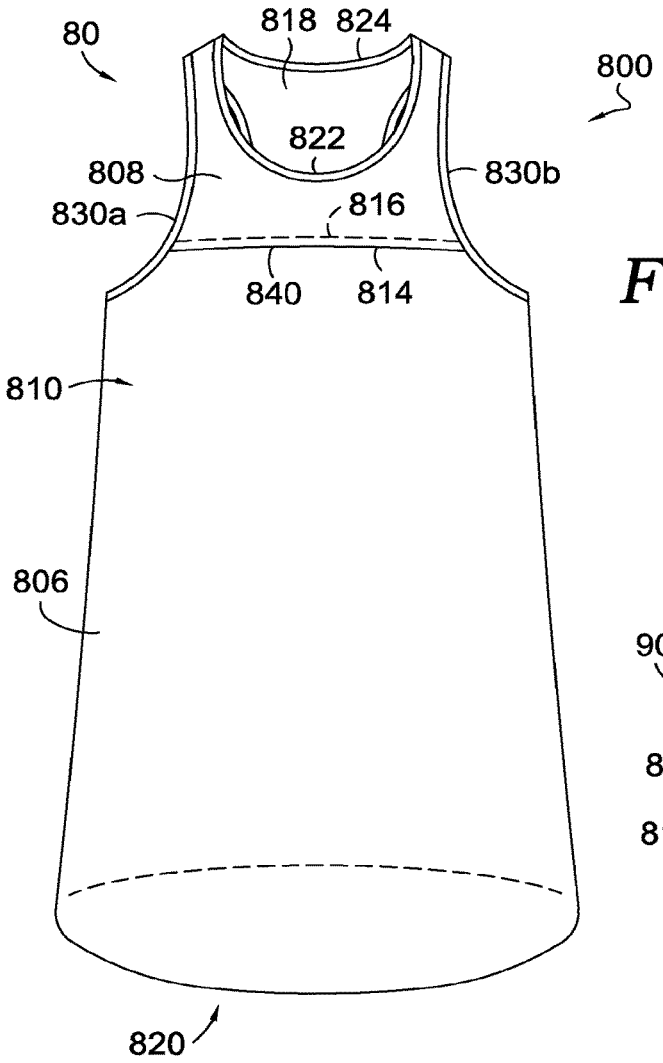
FIG. 8 illustrates a front view of an upper-body garment in a "closed" first state, in accordance with aspects herein.
Figure 9:
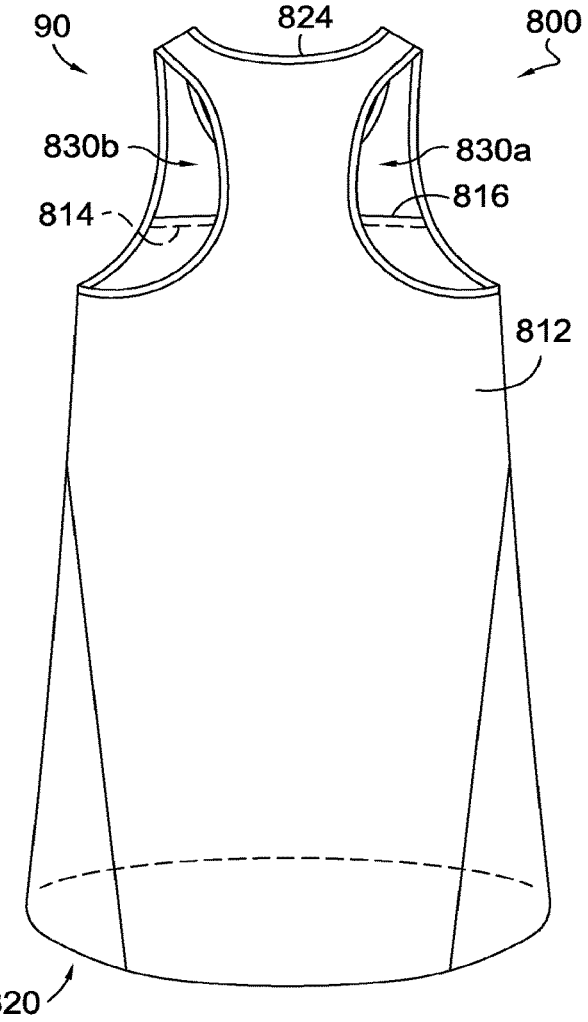
FIG. 9 illustrates a back view of the upper-body garment shown in FIG. 8, in accordance with aspects herein.

FIGS. 8 and 9 show a frontal view 80 and a rear view 90 of an upper-body garment 800, as illustrated in accordance with aspects herein. The upper-body garment 800 is configured to be worn over the multi-layer nursing bra 100, as a nursing bra system 1100, as will become more apparent with respect to FIG. 11. As shown, the upper-body garment 800 comprises a front portion 810 including an upper panel 808, a separate lower panel 806, and a back portion 812. The front portion 810 and the back portion 812 define a neck opening 818 defined by a back collar edge 824 along the back portion 812 and a front collar edge 822 along the front portion 810, a torso opening 820, a first armhole opening 830*a*, and a second armhole opening 830*b*. As shown, the upper panel 808 of the upper-body garment 800 comprises an upper perimeter edge 814 and the lower panel 806 comprises a lower perimeter edge 816. The lower perimeter edge 816 and the upper perimeter edge 814 are overlapped with each other in a closed state of the upper-body garment 800. In example aspects, the lower perimeter edge 816 may be positioned external to the upper perimeter edge 814. In other aspects, the lower perimeter edge 816 may be positioned internal to the upper perimeter edge 814. The upper perimeter edge 814 and the lower perimeter edge 816 are substantially detached from each other and define a nursing opening 840, which will be more apparent with respect to FIG. 10. As can be seen, the nursing opening 840 is located a predefined distance below the front collar edge 822 defining the neck opening 818 (e.g., within from about 10 cm to about 20 cm of the neck opening 818) and above the torso opening 820. Further, as shown in FIG. 9, the back portion 812, in example aspects, may comprise a smaller surface area than the front portion 810. This may be because the back portion 812 is formed from a pattern piece that is narrower in a width-wise direction than the pattern piece used to form the front portion 810. This allows for the upper-body garment 800 to be roomier in the front than the back without the need for ruching, as is conventional in maternity wear. Similar to the multi-layer nursing bra 100, the upper-body garment 800 may be comprised of elastically resilient textile materials. The elastically resilient textile materials forming the upper-body garment 800 may be similar or different to the textile materials used in the multi-layer nursing bra 100, depending on the type of fit desired for the upper-body garment 800.

Figure 10:
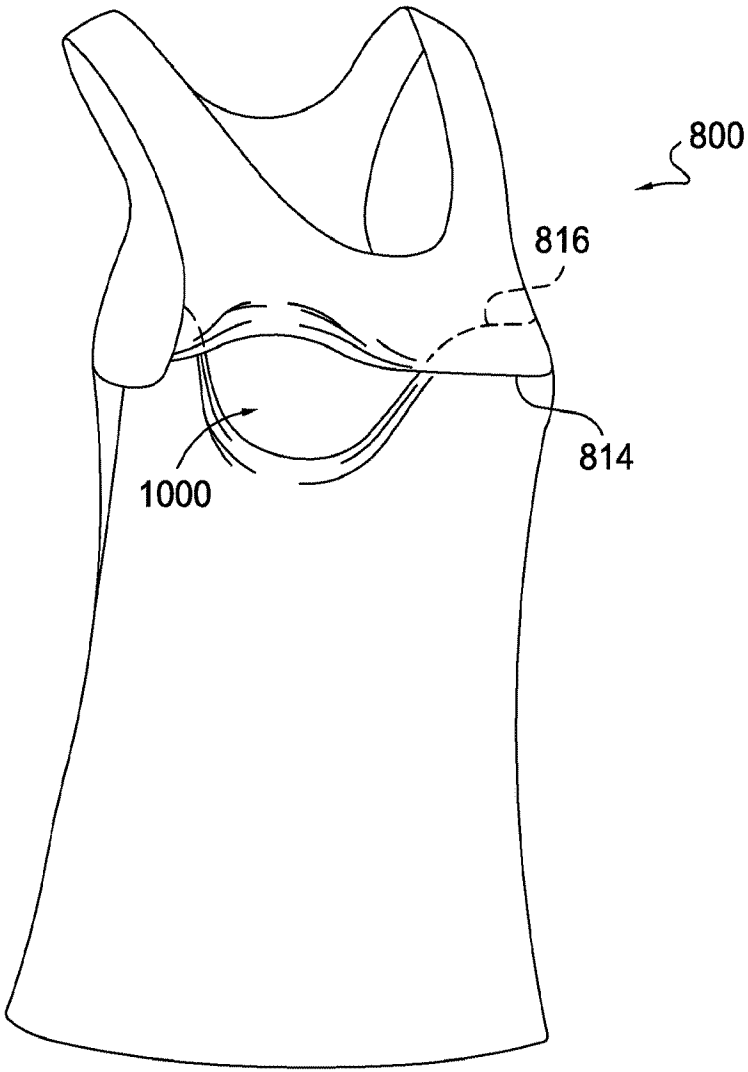
FIG. 10 illustrates the upper-body garment shown in FIG. 8 in an "open" second state, in accordance with aspects herein.

As shown in FIG. 10, the upper-body garment 800 is in an open state, which is achieved by exerting an upward force on the upper perimeter edge 814 of the upper panel 808 and a downward force on the lower perimeter edge 816 of the lower panel 806, to open the nursing opening 840 and form opening 1000.

Figure 11:
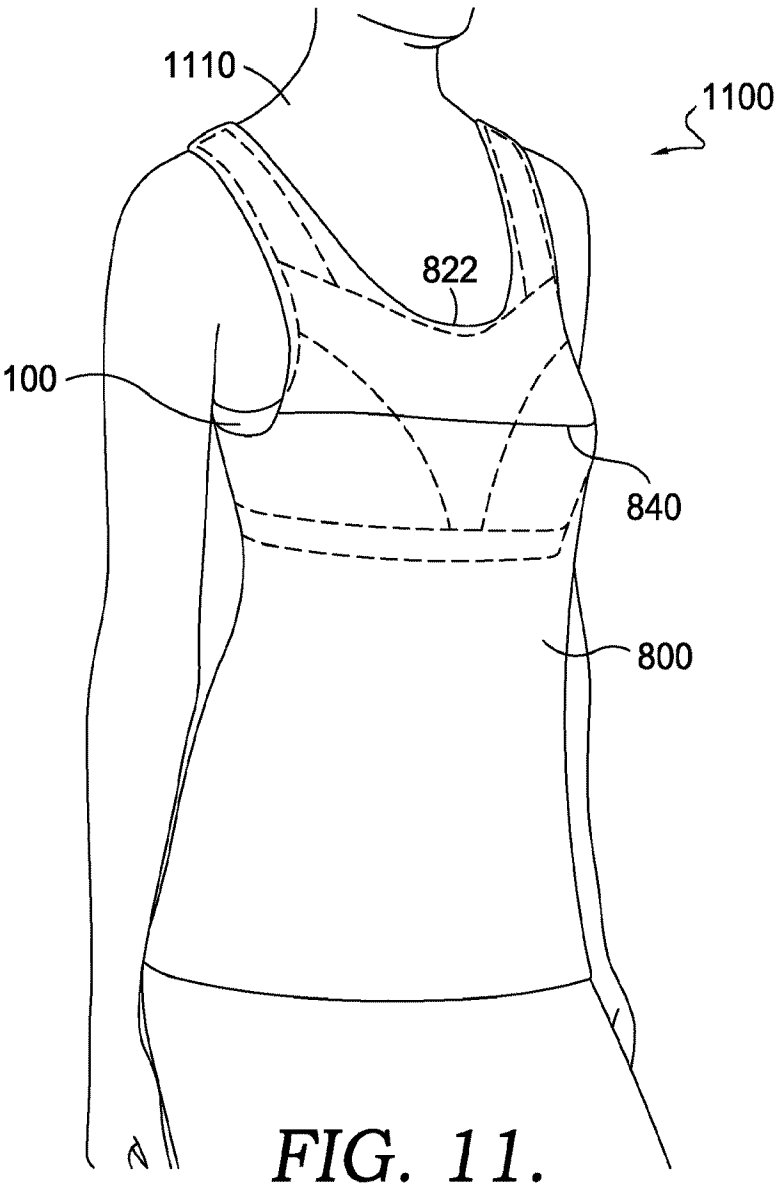
FIG. 11 illustrates a wearer wearing the multi-layer nursing bra shown in FIG. 1 and the upper-body garment shown in FIG. 8, with each of the multi-layer nursing bra and the upper-body garment in a "closed" first state, in accordance with aspects herein.

FIG. 11 shows a wearer 1110 wearing the multi-layer nursing bra 100 and the upper-body garment 800 as a nursing bra system 1100, where the multi-layer nursing bra 100 is worn under the upper-body garment 800 and the upper-body garment 800 is layered on top of the multi-layer nursing bra 100. In FIG. 11, both the multi-layer nursing bra 100 and the upper-body garment 800 are in a closed state. As shown, the nursing opening 840 of the upper-body garment 800 is configured to generally, radially align with the bust area of the wearer 1110, which also coincides with the outer layer 106 overlapping the inner layer 104 of the front portion 102, and more particularly the right edge 125 and the left edge 126 of the outer layer 106 overlapping the upper edge 112 of the inner layer 104.

Figure 12:
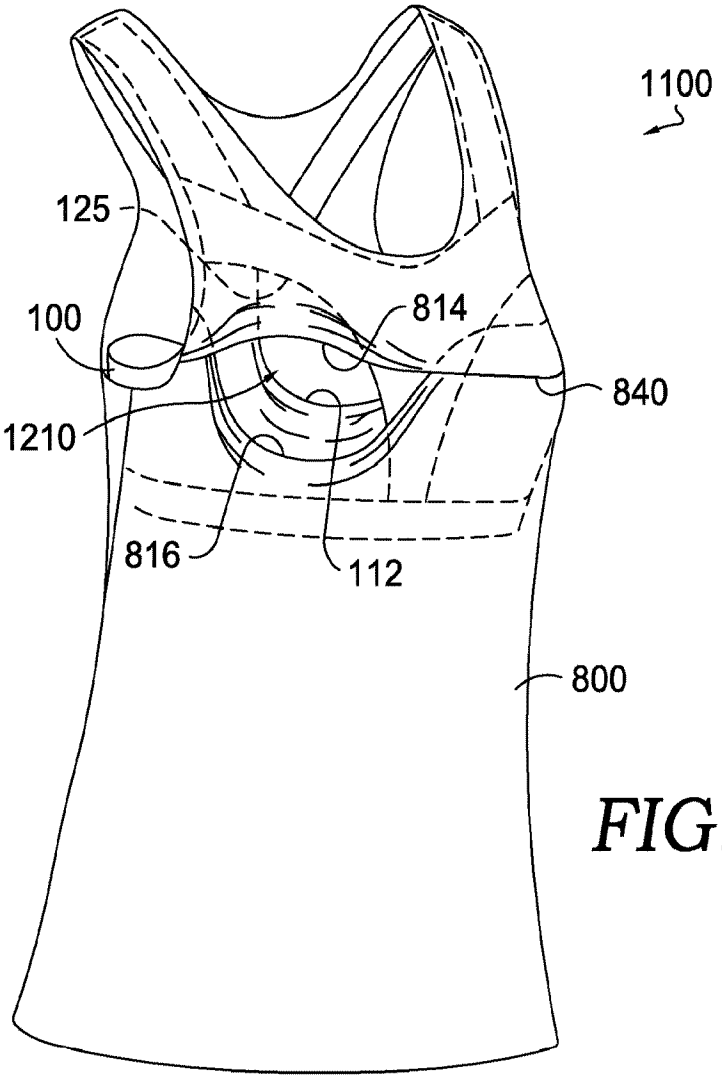
FIG. 12 illustrates the multi-layer nursing bra shown in FIG. 1 and the upper-body garment shown in FIG. 10 in an "open" second state, in accordance with aspects herein.

FIG. 12 depicts the nursing bra system 1100 in an open state to create opening 1210 when both the multi-layer nursing bra 100 and the upper-body garment 800 are transitioned to the open state. As described above, in order to transition from the closed state shown in FIG. 11, the wearer would first transition the nursing opening 840 of the upper-body garment 800 by exerting an upward force on the upper perimeter edge 814 and a downward force on the lower perimeter edge 816. Then, once the multi-layer nursing bra 100 is exposed, the multi-layer nursing bra 100 is transitioned to the open state by exerting an upward force on one or both of the right edge 125 and the left edge 126 of the outer layer 106 (in FIG. 12, only the right edge 125 is transitioned to the open state). Then, once at least a portion of the upper edge 112 of the inner layer 104 is exposed, a downward force is exerted on the upper edge 112 to create opening 1210 that extends through both the upper-body garment 800 and the multi-layer nursing bra 100 to provide access to the nipple area of the wearer. Finally, to transition the nursing bra system 1100 back to its closed state, an upward force is exerted on the upper edge 112 of the inner layer 104 and a downward force is exerted on the respective right edge 125 and/or the left edge 126 of the outer layer 106 of the multi-layer nursing bra 100 followed by exerting an upward force on the lower perimeter edge 816 and a downward force on the upper perimeter edge 814 of the upper-body garment 800.

Figure 13:
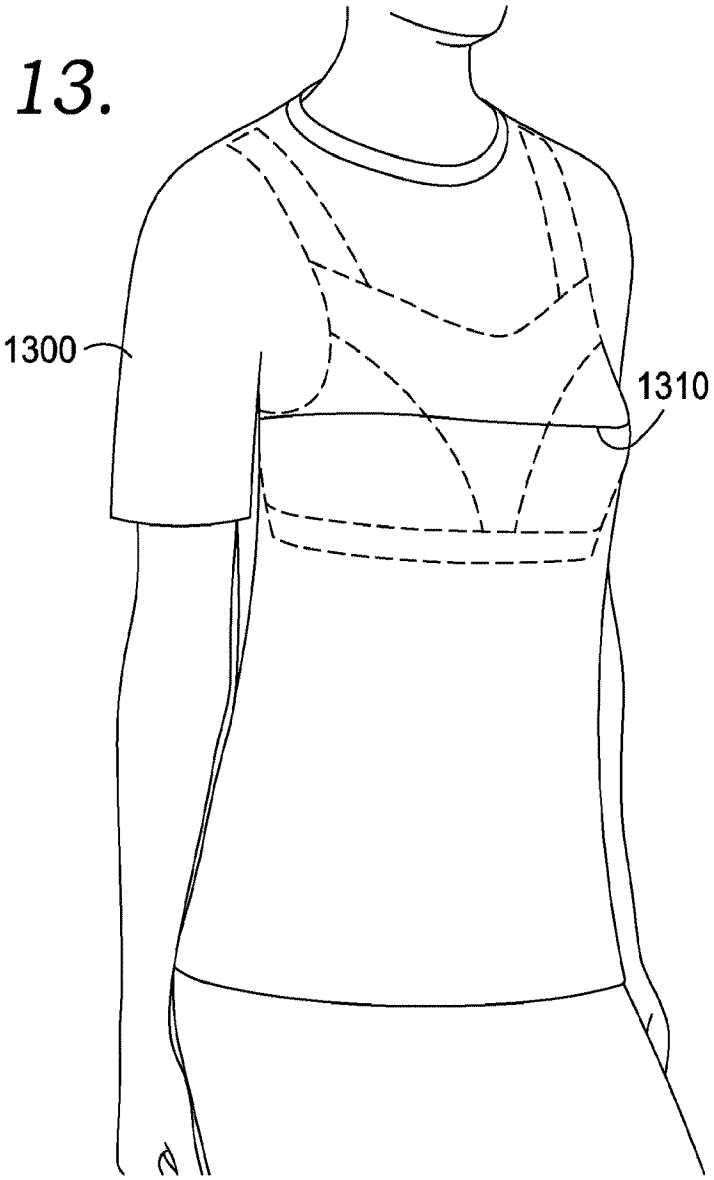
FIG. 13 illustrates a different example nursing bra system in accordance with aspects herein.

Although the example upper-body garment 800 is shown as a tank top style garment, it is contemplated that many other types of garments may be provided with the nursing bra system 1100 in accordance with aspects herein. For example, as shown in FIG. 13, the upper-body garment may be a short sleeved shirt 1300 having nursing opening 1310. In other instances, the upper-body garment may include a dress, shirt, sweater, sweatshirt, hoodie, blouse, and the like that are configured to cover an upper torso area of the wearer. Further, it is also contemplated that the multi-layer nursing bra 100 or the upper-body garment 800 may be worn on their own (i.e., independently of the multi-layer nursing bra 100), without departing from aspects herein.

Figure 14:
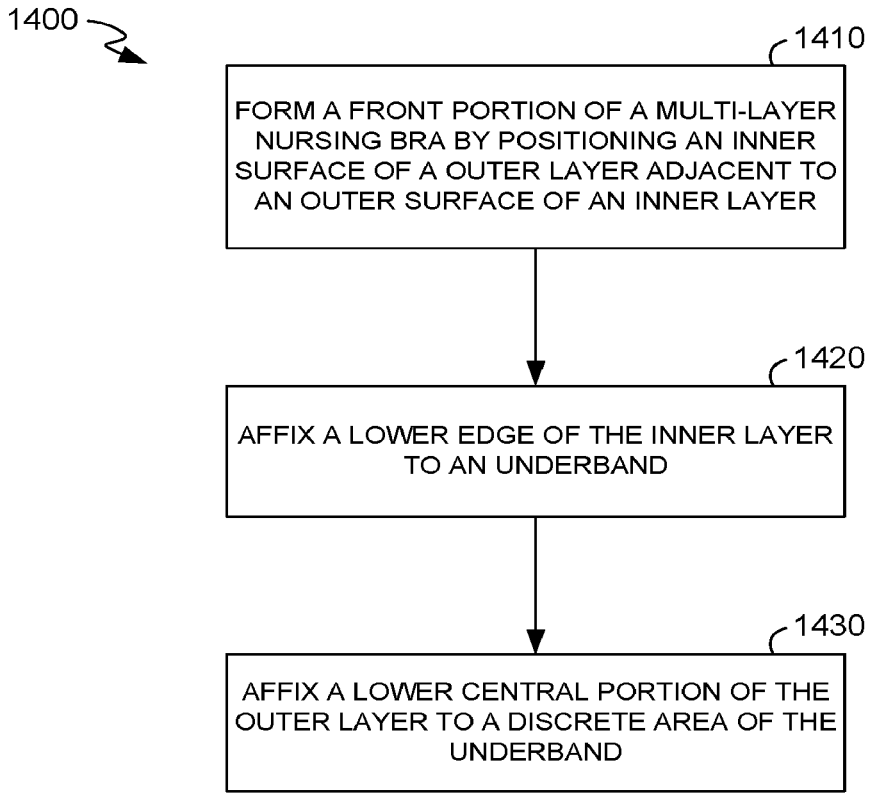
FIG. 14 illustrates a method for manufacturing a multi-layer nursing bra in accordance with aspects herein.

FIG. 14 depicts a series of steps outlining a method 1400 for manufacturing a multi-layer nursing bra, such as the multi-layer nursing bra 100, in accordance with aspects herein. As shown, at a first step 1410, the method 1400 starts by forming a front portion of a multi-layer nursing bra by positioning an inner surface of an outer layer adjacent to an outer surface of an inner layer. Then, as shown at step 1420, a lower edge of the inner layer is affixed to an underband, followed by affixing a lower central portion of the outer layer to a discrete area of the underband, as shown in step 1430. It is contemplated that the order in which the steps are performed may be changed, meaning that the order is discretionary. As well, it is also contemplated that there may be additional steps performed in the manufacture of the multi-layer nursing bra in accordance with aspects herein.

Figure 15:
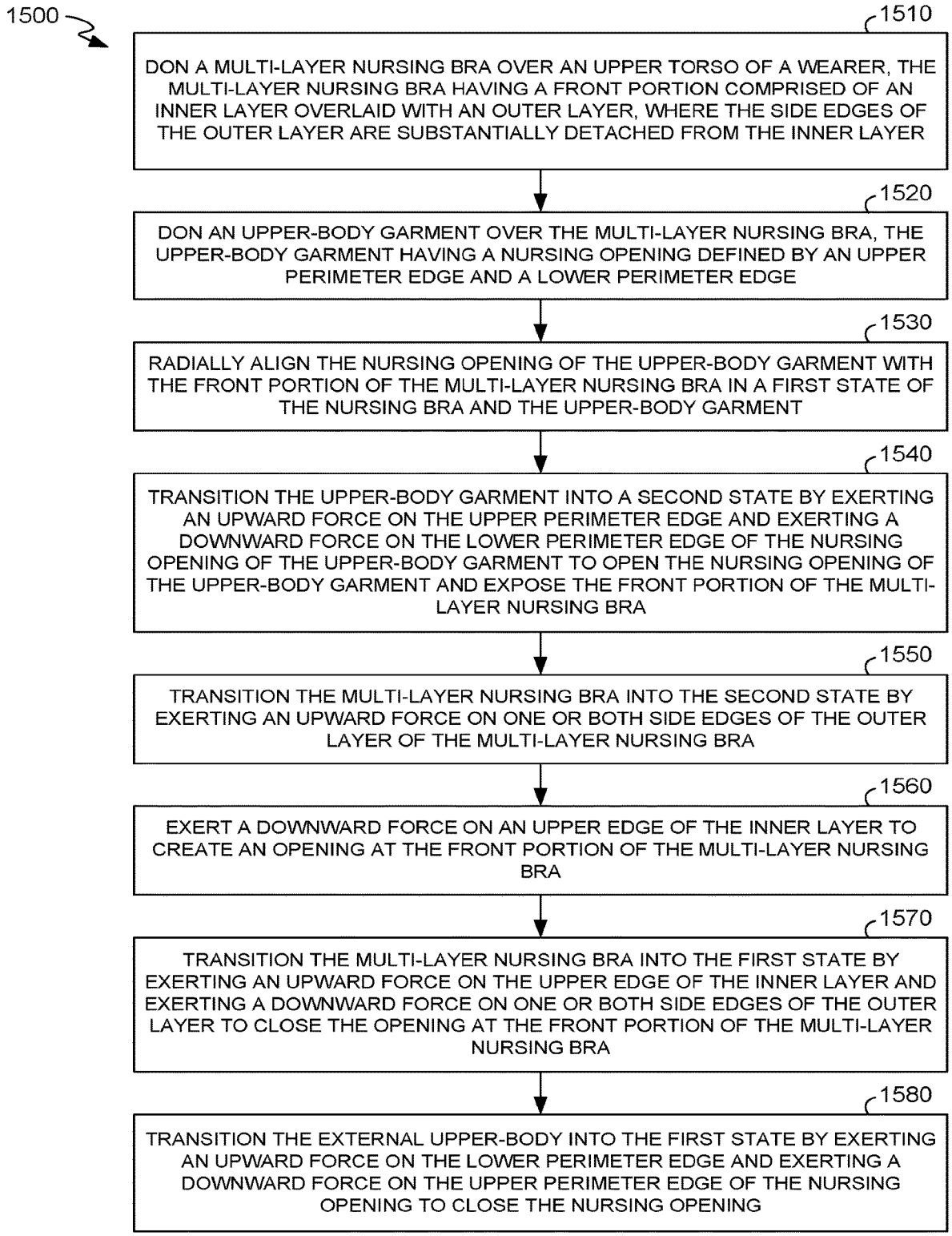
FIG. 15 illustrates a method for using the nursing bra system in accordance with aspects herein.

FIG. 15 depicts a series of steps outlining a method 1500 for using a nursing bra system, such as the nursing bra system 1100, in accordance with aspects herein. For instance, a wearer may don a multi-layer nursing bra (e.g., multi-layer nursing bra 100, multi-layer nursing bra 400, or multi-layer nursing bra 402) over an upper torso of the wearer, as shown at step 1510. Step 1510 is followed by step 1520, which includes donning an upper-body garment (e.g., upper-body garment 800 or 1300) over the multi-layer nursing bra such that a nursing opening of the upper-body garment is radially aligned with a front portion of the multi-layer nursing bra, where both the multi-layer nursing bra and the upper-body garment are in a closed state, as shown at step 1530. When the wearer needs to feed or pump, the multi-layer nursing bra system is transitioned to an open state by first exerting an upward force on an upper perimeter edge defining the nursing opening of the upper-body garment and exerting a downward force on a lower perimeter edge defining the nursing opening of the upper-body garment to open the nursing opening and expose the front portion of the multi-layer nursing bra, as shown at step 1540. This allows the wearer to exert an upward force on one or both of the right edge and/or the left edge of the outer layer to expose at least a portion of an upper edge of the inner layer forming the front portion of the multi-layer nursing bra, as shown at step 1550. Next, a downward force is exerted on the upper edge of the inner layer to create an opening on the front portion of the multi-layer nursing bra to expose a nipple area of the wearer, as shown at step 1560. Once the wearer has finished breast feeding or pumping, the wearer may first return the multi-layer nursing bra to the closed state by exerting an upward force on the upper edge of the inner layer and a downward force on one or both of the right edge and/or the left edge of the outer layer to close the opening on the front portion of the multi-layer nursing bra as shown at step 1570. Finally, the wearer may also return the upper-body garment to the closed state by exerting an upward force on the lower perimeter edge defining the nursing opening and exerting a downward force on the upper perimeter edge defining the nursing opening of the upper-body garment, as shown at step 1580.

Figure 16:
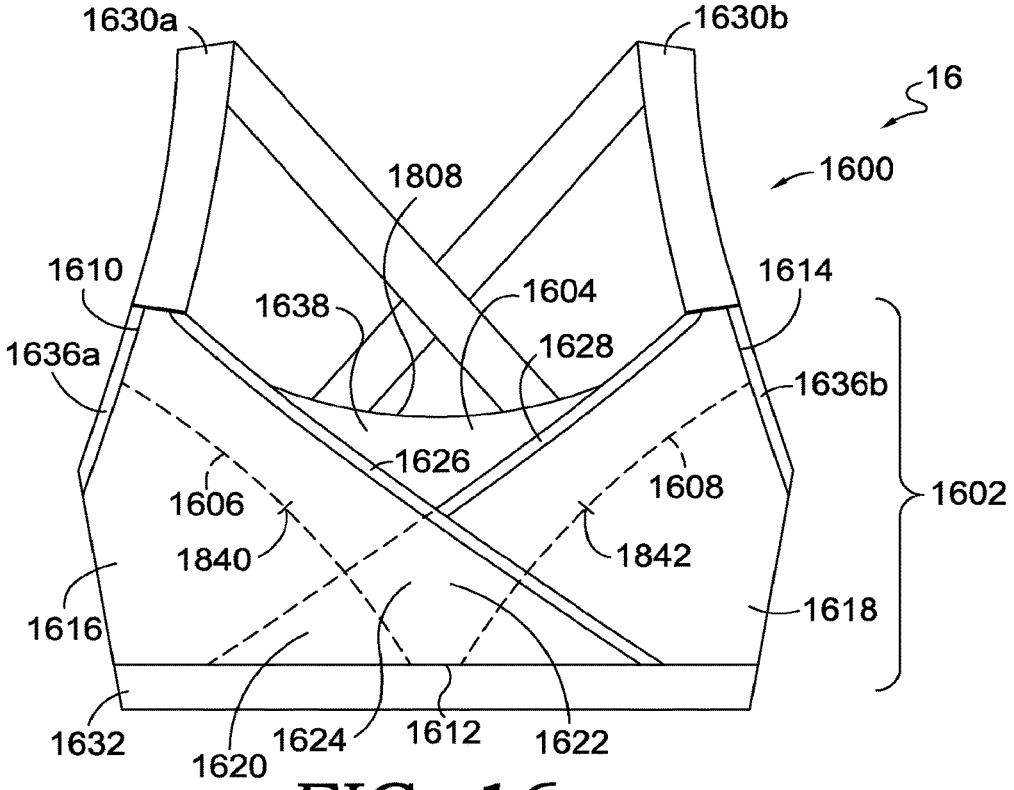
FIG. 16 illustrates a front view of a second example multi-layer nursing bra in a "closed" state, in accordance with aspects herein.

FIG. 16 depicts a front view 16 of another example multi-layer nursing bra 1600 in a closed state, in accordance with aspects herein. When worn, the multi-layer nursing bra 1600 can also be in one of a closed state or an open state. As shown, the multi-layer nursing bra 1600 includes a front portion 1602 having an inner layer 1604 that may have a substantially upright "Y-shape" or a triangular shape with the base of the triangle positioned above the apex. The front portion 1602 also includes an outer layer formed from a right-side outer layer 1616 and a left-side outer layer 1618. As shown, a medial portion 1622 of the right-side outer layer 1616 overlaps a medial portion 1620 of the left-side outer layer 1618 at a center area 1624 of the front portion 1602. Moreover, the right-side outer layer 1616 and the left-side outer layer 1618 are overlying or are positioned adjacent to the inner layer 1604, as will become more apparent with respect to FIG. 18, which shows a deconstructed view 18 of the front portion 1602 of the multi-layer nursing bra 1600. As further shown in FIG. 16, a portion 1638 of the inner layer 1604 is not covered by the right-side outer layer 1616 or the left-side outer layer 1618 when the right-side outer layer 1616 and the left-side outer layer 1618 are layered on top of the inner layer 1604. The multi-layer nursing bra 1600 may optionally comprise a pair of shoulder straps 1630*a* and 1630*b*.

The inner layer 1604 of the multi-layer nursing bra 1600 has an upper edge 1808 extending between an upper right portion 1610 and an upper left portion 1614, a right edge 1606 having a midpoint 1840 extending between the upper right portion 1610 and a lower central portion 1612, and a left edge 1608 having a midpoint 1842 extending between the upper left portion 1614 and the lower central portion 1612. In some aspects, the inner layer 1604 may be comprised of multiple layers of material, while in other aspects, the inner layer 1604 may be comprised of a single layer of material. The upper right portion 1610, the lower central portion 1612, and the upper left portion 1614 are positioned so that the inner layer 1604 forms a substantially upright "Y-shape." In accordance with aspects herein, the right edge 1606, the left edge 1608, and/or the upper edge 1808 of the inner layer 1604 are curved inwardly with respect to a central area 1806 (shown in FIG. 18) of the inner layer 1604 although the right edge 1606, the left edge 1608, and/or the upper edge 1808 may curve outwardly or be substantially straight.

Figure 19:
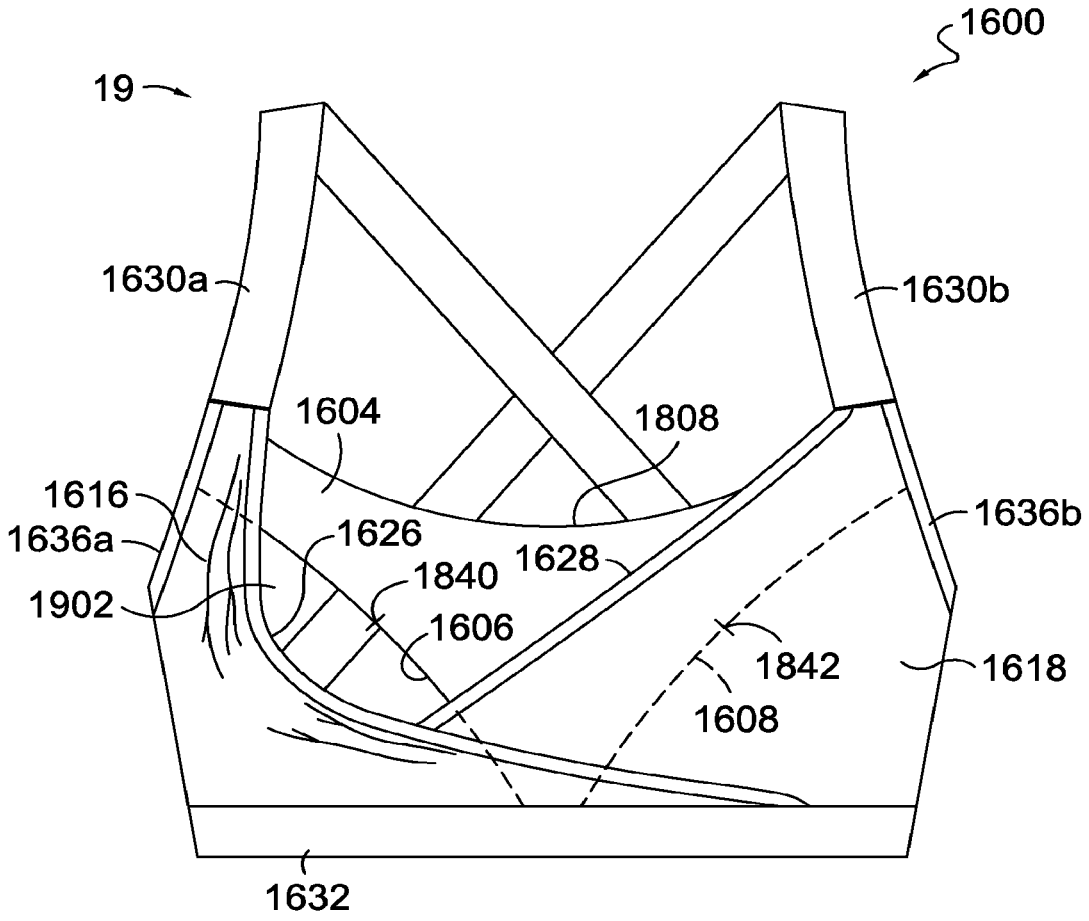
FIG. 19 illustrates the multi-layer nursing bra shown in FIG. 16 as it is being transitioned to an "open" state, in accordance with aspects herein.

The right-side outer layer 1616 has a right-side upper edge 1626, a right-side lower edge, and a right-side edge 1636*a*. The left-side outer layer 1618 has a left-side upper edge 1628, a left-side lower edge, and a left-side edge 1636*b*. The right-side upper edge 1626 and the left-side upper edge 1628 may be finished with a stretch seam such as a zig-zag stitch, a twin needle stitch, a chain stitch, flat lock stitch, cover stitch, overlock stitch (serge stitch), and the like. Alternatively, the right-side upper edge 1626 and the left-side upper edge 1628 may be finished off with a seam with a "hidden" stitch, which is a single, surged interlock stitch sewed while the bra is inside-out. When the bra is flipped right-side out, the stitching is hidden. In other words, the right-side upper edge 1626 and the left-side upper edge 1628 are free of stitching on an outer surface of the multi-layer nursing bra 1600. This hidden stitch may provide for improved comfort and greater stretch along the right-side upper edge 1626 and the left-side upper edge 1628, allowing the right-side outer layer 1616 and/or the left-side outer layer 1618 to be pulled down easier for nursing and/or pumping (as shown in FIG. 19). The right edge 1606 and the left edge 1608 of the inner layer 1604 are substantially detached from the right-side outer layer 1616 and the left-side outer layer 1618. As shown in FIG. 16, when the multi-layer nursing bra 1600 is in a closed state, at least a portion of the right edge 1606 and at least a portion of the left edge 1608 of the inner layer 1604 are positioned below the right-side upper edge 1626 of the right-side outer layer 1616 and the left-side upper edge 1628 of the left-side outer layer 1618 (shown in dashed line to indicate it is generally hidden from view in the closed state). In other words, in the closed state, the right-side upper edge 1626 of the right-side outer layer 1616 and the left-side upper edge 1628 of the left-side outer layer 1618 are located above the right edge 1606 and the left edge 1608 of the inner layer 1604.

Figure 17:
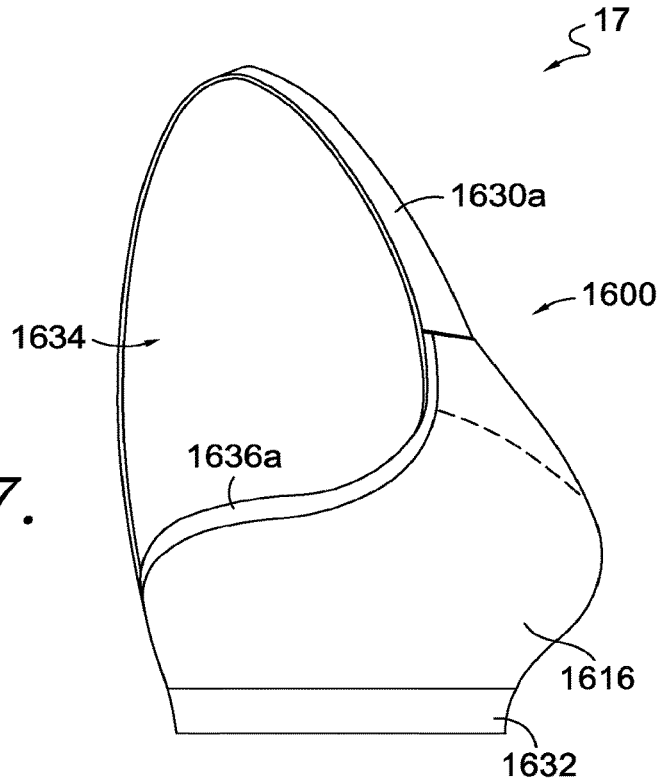
FIG. 17 illustrates a side view of the multi-layer nursing bra shown in FIG. 16, in accordance with aspects herein.

FIG. 17 depicts lateral view 17, where the shoulder strap 1630*a* in combination with the right-side edge 1636*a* of the right-side outer layer 1616, and shoulder strap 1630*b* in combination with the left-side edge 1636*b* of the left-side outer layer 1618, form in part arm openings 1634 through which the wearer may extend her arms when wearing the multi-layer nursing bra 1600. Further, although the shoulder straps 1630*a* and 1630*b* are depicted as being in a crisscross configuration in the back of the multi-layer nursing bra 1600, it is contemplated that the shoulder straps 1630*a* and 1630*b* may have other configurations such as parallel or T-shape. As well, the multi-layer nursing bra 1600 may comprise a strapless configuration, or a halter type configuration without departing from the aspects disclosed herein.

Figure 18:
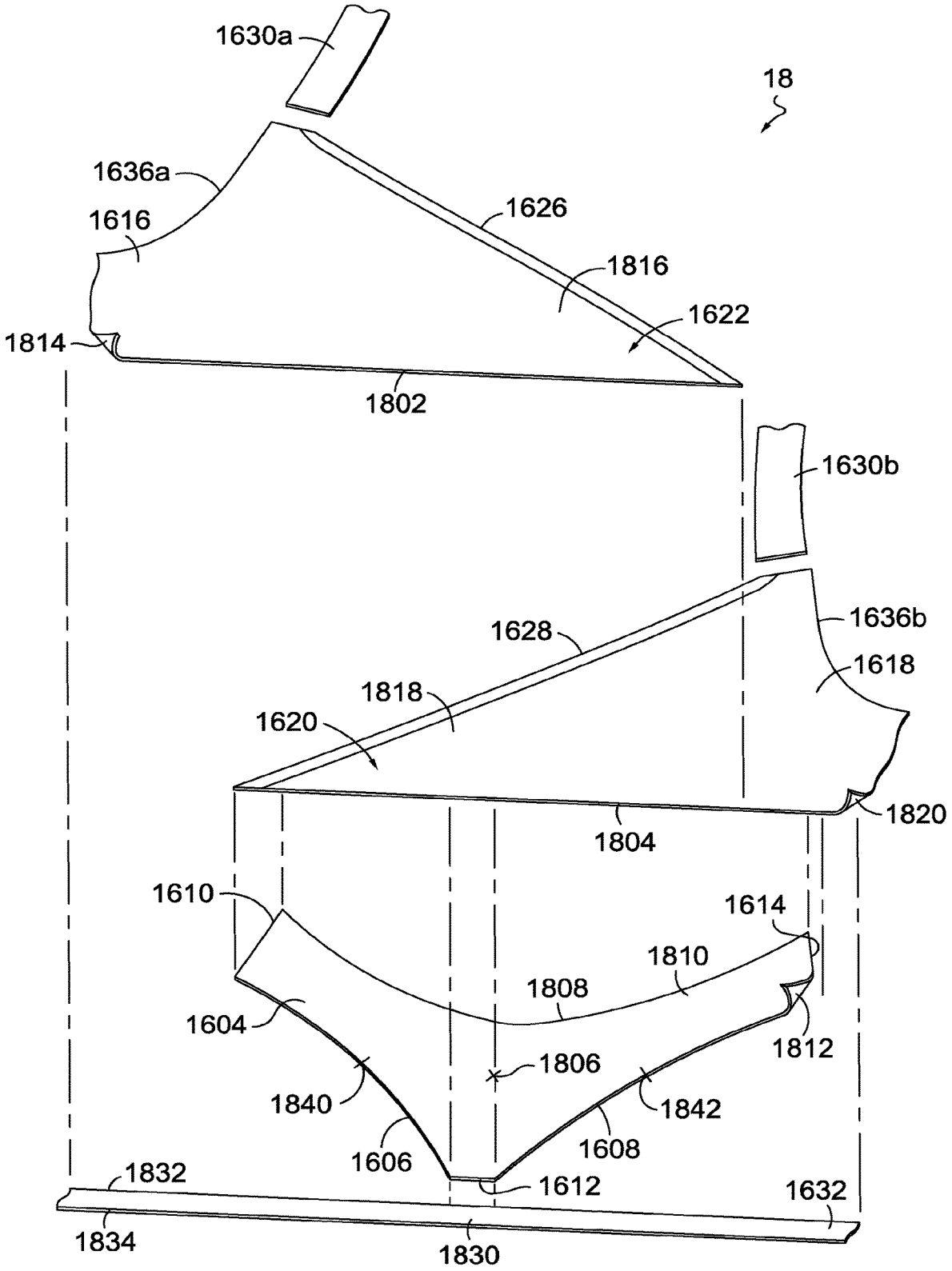
FIG. 18 illustrates a deconstructed view of a front portion of the multi-layer nursing bra shown in FIG. 16 in accordance with aspects herein.

As shown in FIG. 18, the inner layer 1604 has a first or outer surface 1810 and a second or inner surface 1812 opposite the outer surface 1810. Similarly, the right-side outer layer 1616 has a first or outer surface 1816 and a second or inner surface 1814 opposite the outer surface 1816. As well, the left-side outer layer 1618 has a first or outer surface 1818 and a second or inner surface 1820. The outer surface 1810 of the inner layer 1604 is positioned adjacent to the inner surface 1814 of the right-side outer layer 1616 and is further positioned adjacent to the inner surface 1820 of the left-side outer layer 1618.

FIG. 18 also depicts an underband 1632 having an upper edge 1832 and a lower edge 1834. Thus, when the multi-layer nursing bra 1600 is assembled, a right-side lower edge 1802 of the right-side outer layer 1616 and a left-side lower edge 1804 of the left-side outer layer 1618 are secured to the upper edge 1832 of the underband 1632 by sewing, bonding, or other affixing technologies. As well, the lower central portion 1612 of the inner layer 1604 is secured to a central portion 1830 of the underband 1632. Further, the upper right portion 1610 of the inner layer 1604 is affixed to a portion of the right-side edge 1636*a* of the right-side outer layer 1616, and the upper left portion 1614 of the inner layer 1604 is affixed to a portion of the left-side edge 1636*b* of the left-side outer layer 1618. It is contemplated that the underband 1632 may extend at least along the right-side lower edge 1802 of the right-side outer layer 1616 and at least along the left-side lower edge 1804 of the left-side outer layer 1618 of the front portion 1602. When the multi-layer nursing bra 1600 comprises a back portion or right and left wing bands, as described with respect to FIG. 4A and FIG. 4B, the underband 1632 may extend from the lower edge of the back portion or the right and left wing bands.

FIG. 19 depicts a front view 19 of the multi-layer nursing bra 1600 in an open state. Although opening 1902 is only shown on the right side, both the right and the left sides can be transitioned to the open state at or near the same time, or one at a time, as shown. Initially, in order to open a right side of the multi-layer nursing bra 1600, a downward force is exerted on at least a portion of the right-side upper edge 1626 of the right-side outer layer 1616, thereby exposing at least the midpoint 1840 of the right edge 1606 of the inner layer 1604. In other words, the right-side upper edge 1626 is pulled below at least the midpoint 1840 of the right edge 1606 of the inner layer 1604. In example aspects, when the multi-layer nursing bra 1600 is worn, the right edge 1606 of the inner layer 1604 is positioned above the nipple area of a wearer. Once the right-side upper edge 1626 of the right-side outer layer 1616 is pulled downward, an opening 1902 is formed to provide access to the nipple area of the wearer for breast feeding or pumping. In other words, in the open state, at least a portion of the right-side upper edge 1626 of the right-side outer layer 1616 and/or the left-side upper edge 1628 of the left-side outer layer 1618 is located below the right edge 1606 and/or left edge 1608 of the inner layer 1604 to create the opening 1902. Once the breast feeding or pumping is completed, the multi-layer nursing bra 1600 may be returned to the closed state by exerting an upward force on the right-side upper edge 1626 of the right-side outer layer 1616 to return the multi-layer nursing bra 1600 to its closed state, as shown in FIG. 16. This arrangement of multi-layer nursing bra 1600, like the arrangement in the multi-layer nursing bra 100, also provides several advantages by eliminating the need for hard-to-manipulate clasps, uncomfortable pressure points resulting from the clasps, and an ease of manipulation, particularly single-handed manipulation, and the like.

Figure 20:
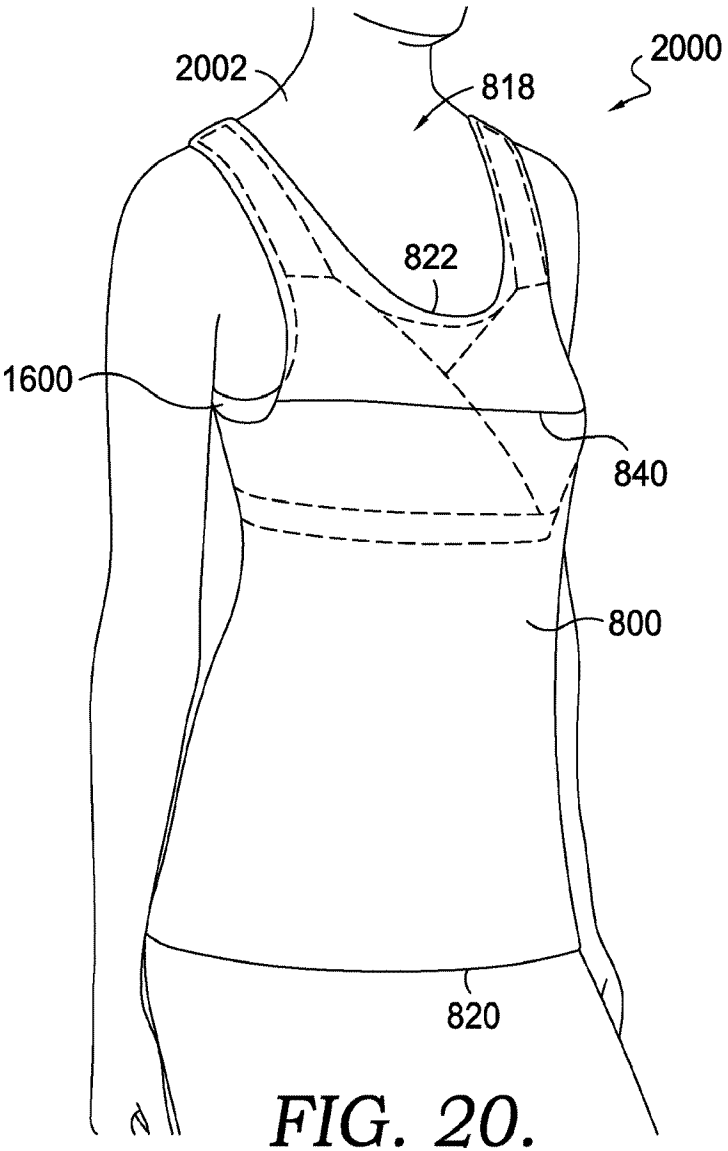
FIG. 20 illustrates a wearer wearing the multi-layer nursing bra shown in FIG. 16 and the upper-body garment shown in FIGS. 8 and 9, with each of the multi-layer nursing bra and the upper-body garment in a "closed" state, in accordance with aspects herein.
Figure 21:
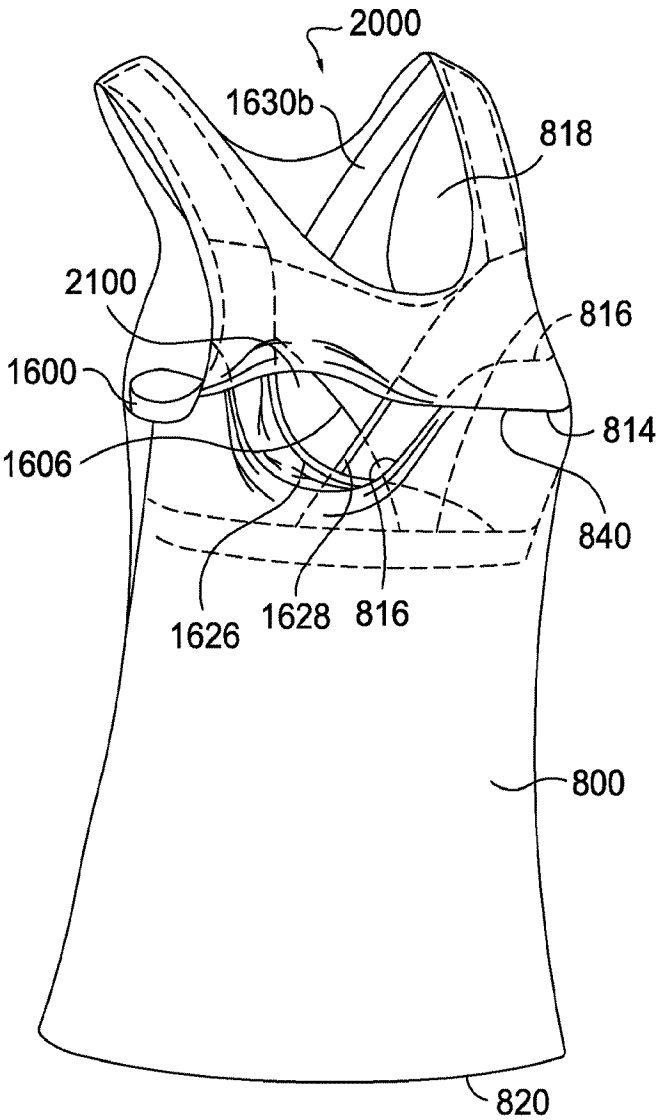
FIG. 21 illustrates the multi-layer nursing bra and the upper-body garment shown in FIG. 20 in an "open" state, in accordance with aspects herein.

Similar to the multi-layer nursing bra 100, 400, and 402 shown in FIGS. 1-7, the multi-layer nursing bra 1600 is also functional to be worn alone or as a system with the upper-body garment 800 or 1300, as discussed above. For example, as shown in FIGS. 20 and 21, the upper-body garment 800 may be donned over the multi-layer nursing bra 1600 such that a wearer 2002 may wear the multi-layer nursing bra 1600 and the upper-body garment 800 as a nursing bra system 2000. In FIG. 20, both the multi-layer nursing bra 1600 and the upper-body garment 800 are in a closed state. As shown, the nursing opening 840 of the upper-body garment 800 is configured to generally, radially align with the bust area of the wearer 2002, which may also generally coincide with at least the midpoint 1840 of the right edge 1606 and the midpoint 1842 of the left edge 1608 of the inner layer 1604 of the front portion 1602.

FIG. 21 depicts the nursing bra system 2000 in an open state to create opening 2100 when both the multi-layer nursing bra 1600 and the upper-body garment 800 are transitioned to the open state. As described above, in order to transition from the closed state shown in FIG. 20, the wearer would first transition the nursing opening 840 of the upper-body garment 800 by exerting an upward force on the upper perimeter edge 814 and a downward force on the lower perimeter edge 816. Then, once the multi-layer nursing bra 1600 is exposed, the multi-layer nursing bra 1600 may also be transitioned to the open state by exerting a downward force on at least a portion of the right-side upper edge 1626 of the right-side outer layer 1616, thereby exposing at least a portion of the right edge 1606 of the inner layer 1604 to create opening 2100 that extends through both the upper-body garment 800 and the multi-layer nursing bra 1600 to provide access to the nipple area of the wearer for breast feeding or pumping. More particularly, the opening 1000 radially aligns with the opening 1902 created between at least one of the right-side upper edge 1626 of the right-side outer layer 1616 or the left-side upper edge 1628 of the left-side outer layer 1618 and the right edge 1606 or the left edge 1608 of the inner layer 1604. Although the multi-layer nursing bra 1600 is shown as being used with the upper-body garment 800, it is also contemplated that the multi-layer nursing bra 1600 may also be used with an upper-body garment having a stretchable neckline that may be pulled down to expose the multi-layer nursing bra 1600 for nursing and/or pumping.

Once the breast feeding or pumping is completed, to transition the nursing bra system 2000 back to its closed state, an upward force is exerted on the right-side upper edge 1626 of the right-side outer layer 1616 to return the multi-layer nursing bra 1600 to its closed state, followed by exerting an upward force on the lower perimeter edge 816 and a downward force on the upper perimeter edge 814 of the upper-body garment 800.

Figure 22:
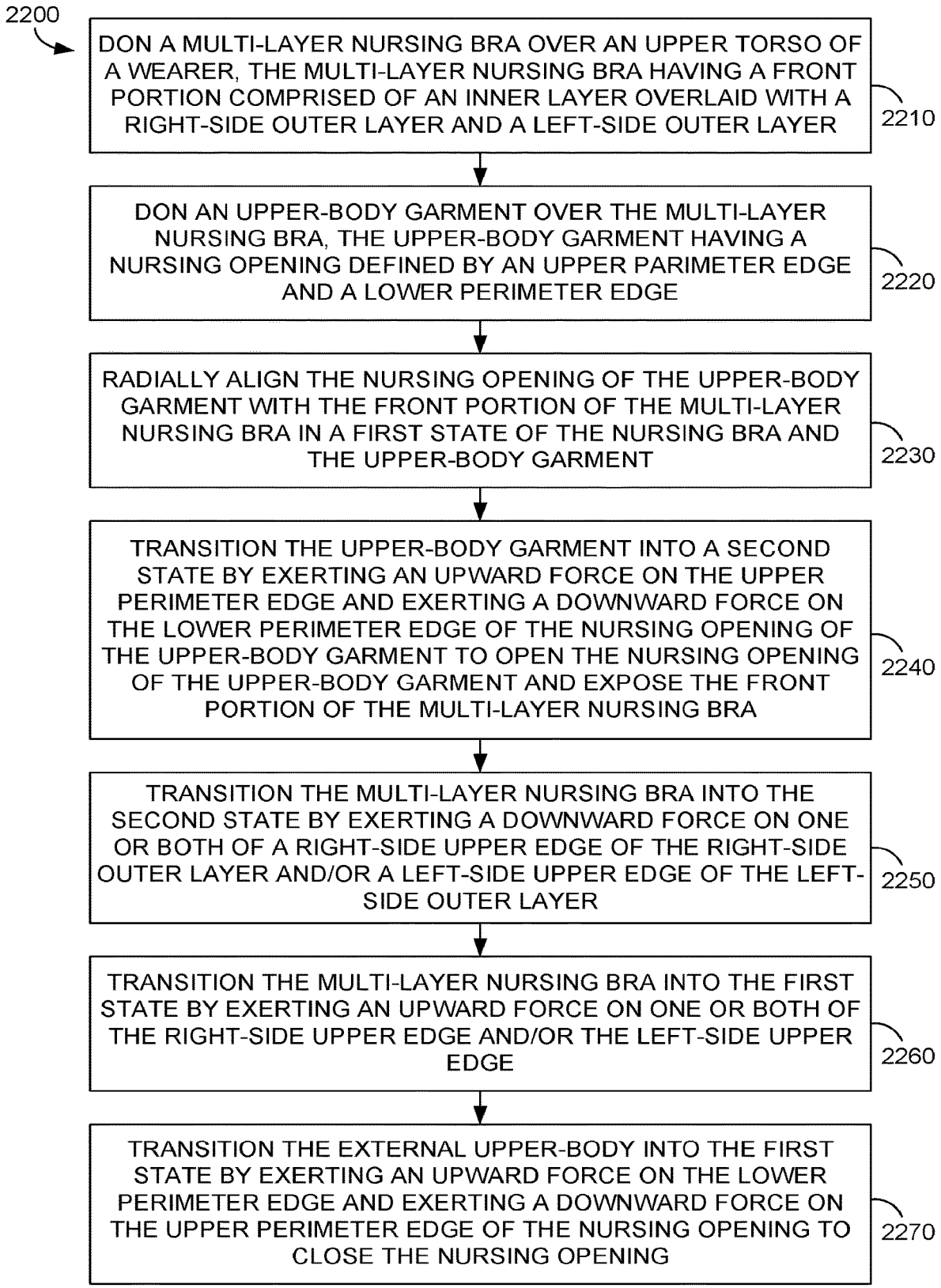
FIG. 22 illustrates a method for using a nursing bra system in accordance with aspects herein.

FIG. 22 depicts a series of steps outlining a method 2200 for using a nursing bra system, such as the nursing bra system 2000, in accordance with aspects herein. For instance, a wearer dons a multi-layer nursing bra (e.g., multi-layer nursing bra 1600) over an upper torso of the wearer, as shown at step 2210. Step 2210 is followed by step 2220, which includes donning an upper-body garment (e.g., upper-body garment 800 or 1300) over the multi-layer nursing bra such that a nursing opening of the upper-body garment is radially aligned with a front portion of the multi-layer nursing bra, where both the multi-layer nursing bra and the upper-body garment are in a closed state, as shown at step 2230. When the wearer needs to feed or pump, the multi-layer nursing bra system may be transitioned to an open state by first exerting an upward force on an upper perimeter edge defining the nursing opening of the upper-body garment and exerting a downward force on a lower perimeter edge defining the nursing opening of the upper-body garment to open the nursing opening and expose the front portion of the multi-layer nursing bra, as shown at step 2240. This allows the wearer to exert a downward force on one or both of a right-side upper edge of the right-side outer layer and/or a left-side upper edge of the left-side outer layer to expose a nipple area of the wearer, as shown at step 2250. Once the wearer has finished breast feeding or pumping, the wearer may first return the multi-layer nursing bra to the closed state by exerting an upward force on one or both of the right-side upper edge and/or the left-side upper edge the upper edge as shown at step 2260. Finally, the wearer may also return the upper-body garment to the closed state by exerting an upward force on the lower perimeter edge defining the nursing opening and exerting a downward force on the upper perimeter edge defining the nursing opening of the upper-body garment, as shown at step 2270.

Clause 1. A multi-layer nursing bra having a front portion comprising: an inner layer extending between an upper edge and a lower edge; a Y-shaped outer layer having an upper right portion, an upper left portion, and a lower central portion, wherein the Y-shaped outer layer is positioned over the inner layer; and an underband extending from the lower edge of the inner layer, wherein the lower central portion of the Y-shaped outer layer is coupled to a central region of the underband.

Clause 2. The multi-layer nursing bra according to clause 1, wherein the inner layer is comprised of a first elastically resilient textile material, and the Y-shaped outer layer is comprised of a second elastically resilient textile material, and wherein a modulus of elasticity of the first elastically resilient textile material is substantially equal to a modulus of elasticity of the second elastically resilient textile material.

Clause 3. The multi-layer nursing bra according to clause 1, wherein the inner layer is comprised of a first elastically resilient textile material and the Y-shaped outer layer is comprised of a second elastically resilient textile material, wherein the first elastically resilient textile material has a different modulus of elasticity from the second elastically resilient textile material.

Clause 4. The multi-layer nursing bra according to any of clauses 1 through 3, further comprising a back portion extending from the front portion, wherein the underband further extends from a lower edge of the back portion.

Clause 5. The multi-layer nursing bra according to clause 4, further comprising a pair of shoulder straps extending between the front portion and the back portion.

Clause 6. The multi-layer nursing bra according to any of clauses 1 through 5, wherein the Y-shaped outer layer further comprises a right edge extending between the upper right portion and the lower central portion, a left edge extending between the upper left portion and the lower central portion, and wherein the Y-shaped outer layer seamlessly and continuously extends between the right edge and the left edge.

Clause 7. The multi-layer nursing bra according to clause 6, wherein the Y-shaped outer layer is moveable relative to the inner layer along at least a midpoint of the right edge and along at least a midpoint of the left edge.

Clause 8. The multi-layer nursing bra according to any of clauses 6 and 7, wherein the right edge and the left edge of the Y-shaped outer layer are curved edges.

Clause 9. The multi-layer nursing bra according to clause 6 through 8, wherein the right edge and the left edge of the Y-shaped outer layer curve inwardly with respect to a central area of the Y-shaped outer layer.

Clause 10. The multi-layer nursing bra according to any of clauses 6 through 9, wherein when the multi-layer nursing bra is in a closed state, the right edge and the left edge of the Y-shaped outer layer are positioned below the upper edge of the inner layer, and wherein when the multi-layer nursing bra is in an open state, at least a portion of the upper edge of the inner layer is positioned below one or more of a midpoint of the right edge and a midpoint of the left edge of the Y-shaped outer layer.

Clause 11. The multi-layer nursing bra according to any of clauses 1 through 10, wherein the Y-shaped outer layer further comprises an upper edge extending between the upper right portion and the upper left portion, and wherein the upper edge of the inner layer is positioned below the upper edge of the Y-shaped outer layer.

Clause 12. The multi-layer nursing bra according to clause 11, wherein the right edge, the left edge, and the upper edge of the Y-shaped outer layer are substantially detached from the inner layer.

Clause 13. The multi-layer nursing bra according to any of clauses 1 through 12, wherein one or more portions of the inner layer are not covered by the Y-shaped outer layer.

Clause 14. The multi-layer nursing bra according to any of clauses 1 through 3 and 6 through 13, further comprising a right wing band extending from a right side of the front portion, and a left wing band extending from a left side of the front portion.

Clause 15. The multi-layer nursing bra according to clause 14, further comprising a first component of a closure mechanism coupled to a terminal end of the right wing band, and a second component of the closure mechanism coupled to a terminal end of the left wing band, wherein the first component of the closure mechanism is releasably coupled to the second component of the closure mechanism.

Clause 16. The multi-layer nursing bra according to any of clauses 14 and 15, further comprising a first shoulder strap extending between the front portion and the right wing band, and a second shoulder strap extending between the front portion and the left wing band.

Clause 17. A multi-layer nursing bra having a front portion comprising: an inner layer; and an outer layer adjacent to the inner layer, the outer layer having a right edge extending between an upper right portion and a lower central portion of the outer layer, and a left edge extending between an upper left portion and the lower central portion of the outer layer, wherein the right edge and the left edge converge as they extend toward the lower central portion of the outer layer, and wherein the outer layer is moveable relative to the inner layer along at least a midpoint of the right edge and along at least a midpoint of the left edge.

Clause 18. The multi-layer nursing bra according to clause 17, wherein the outer layer is substantially Y-shaped.

Clause 19. The multi-layer nursing bra according to any of clauses 17 through 18, wherein the right edge and the left edge of the outer layer are curved.

Clause 20. The multi-layer nursing bra according to any of clauses 17 through 19, wherein the inner layer is comprised of a first elastically resilient textile material and the outer layer is comprised of a second elastically resilient textile material, wherein a modulus of elasticity of the first elastically resilient textile material is substantially equal to a modulus of elasticity of the second elastically resilient textile material.

Clause 21. The multi-layer nursing bra according to any of clauses 17 through 19, wherein the inner layer is comprised of a first elastically resilient textile material and the outer layer is comprised of a second elastically resilient textile material, wherein a modulus of elasticity of the first elastically resilient textile material is different from a modulus of elasticity of the second elastically resilient textile material.

Clause 22. The multi-layer nursing bra according to any of clauses 17 through 21, further comprising a back portion extending from the front portion.

Clause 23. The multi-layer nursing bra according to clause 22, further comprising a pair of shoulder straps extending between the front portion and the back portion.

Clause 24. The multi-layer nursing bra according to any of clauses 17 through 23, wherein the outer layer seamlessly and continuously extends between the right edge and the left edge.

Clause 25. The multi-layer nursing bra according to any of clauses 17 through 24, wherein an upper edge of the inner layer is moveable relative to the outer layer.

Clause 26. The multi-layer nursing bra according to any of clauses 17 through 25, wherein one or more portions of the inner layer are not covered by the outer layer.

Clause 27. A method of manufacturing a multi-layer nursing bra comprising: forming a front portion of the multi-layer nursing bra by positioning an outer layer over an inner layer, the outer layer having a right edge extending between an upper right portion and a lower central portion of the outer layer, and a left edge extending between an upper left portion and the lower central portion of the outer layer, wherein the right edge and the left edge converge as they extend toward the lower central portion of the outer layer; and affixing the lower central portion of the outer layer to a lower central portion of the inner layer.

Clause 28. The method of manufacturing the multi-layer nursing bra according to clause 27, further comprising coupling a back portion to the front portion of the multi-layer nursing bra.

Clause 29. The method of manufacturing the multi-layer nursing bra according to clause 28, further comprising: coupling first strap ends of a pair of shoulder straps to the front portion; and coupling second strap ends of the pair of shoulder straps to the back portion.

Clause 30. The method of manufacturing the multi-layer nursing bra according to any of clauses 27 through 29, wherein the right edge and the left edge of the outer layer are substantially detached from the inner layer, and wherein the outer layer is moveable relative to the inner layer along at least a midpoint of the right edge and along at least a midpoint of the left edge.

Clause 31. The method of manufacturing the multi-layer nursing bra according to any of clauses 27 through 30, wherein the right edge and the left edge of the outer layer are curved.

Clause 32. The method of manufacturing the multi-layer nursing bra according to any of clauses 27, 30, and 31, further comprising: coupling a right wing band to a right side of the front portion; and coupling a left wing band to a left side of the front portion, wherein the right wing band and the left wing band comprise a closure mechanism that releasably secures the right wing band to the left wing band.

Clause 33. The method of manufacturing the multi-layer nursing bra according to clause 32, further comprising: coupling first strap ends of a pair of shoulder straps to the front portion; and coupling second strap ends of the pair of shoulder straps to the right wing band and the left wing band, respectively.

Clause 34. A multi-layer nursing bra comprising: a front portion having a first textile layer with a first superior edge, a first inferior edge, a first inner surface, and a first outer surface, and the front portion further having a second textile layer with a second inner surface positioned adjacent to the first outer surface of the first textile layer, a second outer surface, a first superior terminal end, a second superior terminal end, a third inferior terminal end, and a second superior edge extending between the first superior terminal end and the second superior terminal end; and an underband extending continuously along the first inferior edge of the first textile layer, wherein the third inferior terminal end of the second textile layer is secured to a mid-area of the underband at a location generally equidistant between the first superior terminal end and the second superior terminal end of the second textile layer.

Clause 35. The multi-layer nursing bra according to clause 34, further comprising a back portion coupled to the first textile layer of the front portion.

Clause 36. The multi-layer nursing bra according to clause 35, further comprising a pair of shoulder straps coupled to the front portion and the back portion.

Clause 37. The multi-layer nursing bra according to any of clauses 34 through 36, wherein the second textile layer comprises a first side edge extending between the first superior terminal end and the third inferior terminal end, and a second side edge extending between the second superior terminal end and the third inferior terminal end, and wherein the second textile layer seamlessly and continuously extends between the first side edge and the second side edge.

Clause 38. The multi-layer nursing bra according to clause 37, wherein the second superior edge, the first side edge, and the second side edge of the second textile layer are substantially detached from the first textile layer.

Clause 39. The multi-layer nursing bra according to any of clauses 37 through 38, wherein in a first state, the first side edge or the second side edge of the second textile layer is positioned inferior to the first superior edge of the first textile layer.

Clause 40. The multi-layer nursing bra according to any of clauses 37 through 39, wherein in a second state, at least a portion of the first side edge or the second side edge of the second textile layer is positioned superior to the first superior edge of the first textile layer to form an opening.

Clause 41. The multi-layer nursing bra according to clause 40, wherein the second superior edge of the second textile layer is positioned superior to the first superior edge of the first textile layer in both the first state and the second state.

Clause 42. The multi-layer nursing bra according to any of clauses 34 through 41, wherein the first superior terminal end of the second textile layer is secured to a portion of a first lateral side edge of the first textile layer, and wherein the second superior terminal end of the second textile layer is secured to a portion of a second lateral side edge of the first textile layer.

Clause 43. The multi-layer nursing bra according to any of clauses 34 through 42, wherein one or more portions of the first outer surface of the first textile layer are not covered by the second textile layer.

Clause 44. A method for manufacturing a multi-layer nursing bra: forming a front portion of the multi-layer nursing bra by positioning an inner surface of a second textile layer adjacent to an outer surface of a first textile layer, wherein the second textile layer comprises a first superior terminal end, a second superior terminal end, a third inferior terminal end, and a second superior edge extending between the first superior terminal end and the second superior terminal end, and wherein the first textile layer comprises a first superior edge and an inferior edge; affixing an underband along a length of the inferior edge of the first textile layer; and affixing the third inferior terminal end of the second textile layer to a discrete area of the underband.

Clause 45. The method for manufacturing the multi-layer nursing bra according to clause 44, further comprising: affixing the first superior terminal end of the second textile layer to a portion of a first lateral side edge of the first textile layer; and affixing the second superior terminal end of the second textile layer to a portion of a second lateral side edge of the first textile layer.

Clause 46. The method for manufacturing the multi-layer nursing bra according to any of clauses 44 through 45, further comprising: affixing a third textile layer to the first textile layer to form a back portion of the nursing garment.

Clause 47. The method for manufacturing the multi-layer nursing bra according to clause 46, further comprising: affixing first strap ends of a pair of shoulder straps to the front portion; and affixing second strap ends of the pair of shoulder straps to the back portion.

Clause 48. The method for manufacturing the multi-layer nursing bra according to any of clauses 44 through 47, wherein the discrete area of the underband to which the third inferior terminal end of the second textile layer is affixed, corresponds to a location generally equidistant between the first superior terminal end and the second superior terminal end of the second textile layer.

Clause 49. The method for manufacturing the multi-layer nursing bra according to any of clauses 44 through 48, wherein the second textile layer further comprises a first side edge extending between the first superior terminal end and the third inferior terminal end, and a second side edge extending between the second superior terminal end and the third inferior terminal end.

Clause 50. The method for manufacturing the multi-layer nursing bra according to clause 49, wherein the second superior edge, the first side edge, and the second side edge of the second textile layer are substantially detached from the first textile layer.

Clause 51. The method for manufacturing the multi-layer nursing bra according to any of clauses 44 through 50, wherein one or more portions of the outer surface of the first textile layer are not covered by the second textile layer.

Clause 52. A multi-layer nursing bra comprising: a front portion comprising a first textile layer having a first superior edge, a first inferior edge, a first inner surface, and a first outer surface, and a second textile layer having a second inner surface positioned adjacent to the first outer surface of the first textile layer, a second outer surface, a first superior terminal end, a second superior terminal end, a third inferior terminal end, and a second superior edge extending between the first superior terminal end and the second superior terminal end; a first wing band extending from a first lateral side of the first textile layer, the first wing band comprising a first lateral side edge defining a first underarm perimeter portion of the first wing band, and a first underband edge; a second wing band extending from a second lateral side of the first textile layer, the second wing band comprising a second lateral side edge defining a second underarm perimeter portion of the second wing band, and a second underband edge; and an underband extending continuously along the first inferior edge of the first textile layer, the first underband edge, and the second underband edge, wherein the third inferior terminal end of the second textile layer is secured to the underband at a mid-area of the first inferior edge of the front portion.

Clause 53. The multi-layer nursing bra according to clause 52 further comprising a first component of a closure mechanism affixed to a terminal end of the first wing band and a second component of the closure mechanism affixed to a terminal end of the second wing band, wherein the first component of the closure mechanism is adapted to be releasably coupled to the second component of the closure mechanism.

Clause 54. The multi-layer nursing bra according to clause 53, wherein the closure mechanism is adjustable.

Clause 55. The multi-layer nursing bra according to any of clauses 52 through 54 further comprising a first shoulder strap extending from the front portion and the first wing band, and a second shoulder strap extending from the front portion and the second wing band.

Clause 56. A nursing bra system comprising: a multi-layer nursing bra having a front portion comprising: an inner layer extending between an upper edge and a lower edge; a Y-shaped outer layer having an upper right portion, an upper left portion, and a lower central portion, wherein the Y-shaped outer layer is positioned over the inner layer; and an underband extending from the lower edge of the inner layer, wherein the lower central portion of the Y-shaped outer layer is coupled to a central region of the underband; and an upper-body garment configured to be worn over the multi-layer nursing bra, the upper-body garment comprising: a front portion and a back portion that together define at least a neck opening and a torso opening; and a nursing opening extending from a right side of the front portion to a left side of the front portion, wherein the nursing opening is positioned below the neck opening and above the torso opening.

Clause 57. The nursing bra system according to clause 56, wherein the inner layer of the multi-layer nursing bra is comprised of a first elastically resilient textile material and the Y-shaped outer layer of the multi-layer nursing bra is comprised of a second elastically resilient textile material, wherein a modulus of elasticity of the first elastically resilient textile material is substantially equal to a modulus of elasticity of the second elastically resilient textile material.

Clause 58. The nursing bra system according to clause 56, wherein the inner layer of the multi-layer nursing bra is comprised of a first elastically resilient textile material and the Y-shaped outer layer of the multi-layer nursing bra is comprised of a second elastically resilient textile material, wherein the first elastically resilient textile material has a different modulus of elasticity from the second elastically resilient textile material.

Clause 59. The nursing bra system according to any of clauses 56 through 58, the multi-layer nursing bra further comprising a back portion extending from the front portion, wherein the underband further extends from a lower edge of the back portion.

Clause 60. The nursing bra system according to clause 59, the multi-layer nursing bra further comprising a pair of shoulder straps extending between the front portion and the back portion.

Clause 61. The nursing bra system according to any of clauses 56 through 60, wherein the Y-shaped outer layer of the multi-layer nursing bra further comprises a right edge extending between the upper right portion and the lower central portion, a left edge extending between the upper left portion and the lower central portion, and wherein the Y-shaped outer layer seamlessly and continuously extends between the right edge and the left edge of the Y-shaped outer layer.

Clause 62. The nursing bra system according to clauses 56 through 61, wherein when the nursing bra system is in a closed state: the right edge and the left edge of the Y-shaped outer layer of the multi-layer nursing bra are positioned below the upper edge of the inner layer of the multi-layer nursing bra, and the nursing opening of the upper-body garment is closed; and wherein when the nursing bra system is in an open state: at least a portion of the upper edge of the inner layer of the multi-layer nursing bra is positioned below one or more of a midpoint of the right edge and a midpoint of the left edge of the Y-shaped outer layer of the multi-layer nursing bra, and the nursing opening of the upper-body garment is open.

Clause 63. The nursing bra system according to any of clauses 56 through 62: wherein the right edge and the left edge of the Y-shaped outer layer of the multi-layer nursing bra are substantially detached from the inner layer of the multi-layer nursing bra, and wherein the Y-shaped outer layer of the multi-layer nursing bra is moveable relative to the inner layer of the multi-layer nursing bra along at least a midpoint of the right edge and along at least a midpoint of the left edge.

Clause 64. A nursing bra system comprising: a multi-layer nursing bra having a front portion comprising: an inner layer; and an outer layer adjacent to the inner layer, the outer layer having a right edge extending between an upper right portion and a lower central portion of the outer layer, and a left edge extending between an upper left portion and the lower central portion of the outer layer, wherein the right edge and the left edge converge as they extend toward the lower central portion of the outer layer, and wherein the outer layer is moveable relative to the inner layer along at least a midpoint of the right edge and along at least a midpoint of the left edge; and an upper-body garment configured to be worn over the multi-layer nursing bra, the upper-body garment comprising: a front portion and a back portion that together define at least a neck opening and a torso opening; and a nursing opening extending from a right side of the front portion to a left side of the front portion, wherein the nursing opening is positioned below the neck opening and above the torso opening.

Clause 65. The nursing bra system according to clause 64, the multi-layer nursing bra further comprising a right wing band extending from a right side of the front portion, and a left wing band extending from a left side of the front portion.

Clause 66. The nursing bra system according to clause 65, the multi-layer nursing bra further comprising a first component of a closure mechanism coupled to a terminal end of the right wing band, and a second component of the closure mechanism coupled to a terminal end of the left wing band, wherein the first component of the closure mechanism is releasably coupled to the second component of the closure mechanism.

Clause 67. The nursing bra system according to any of clauses 65 through 66, the multi-layer nursing bra further comprising a first shoulder strap extending between the front portion and the right wing band, and a second shoulder strap extending between the front portion and the left wing band.

Clause 68. The nursing bra system according to any of clauses 64 through 67, wherein the outer layer of the multi-layer nursing bra is substantially Y-shaped.

Clause 69. The nursing bra system according to any of clauses 64 through 68, wherein the right edge and the left edge of the outer layer of the multi-layer nursing bra are curved.

Clause 70. The nursing bra system according to any of clauses 64 through 69, wherein the inner layer of the multi-layer nursing bra is comprised of a first elastically resilient textile material and the outer layer of the multi-layer nursing bra is comprised of a second elastically resilient textile material, and wherein a modulus of elasticity of the first elastically resilient textile material is substantially equal to a modulus of elasticity of the second elastically resilient textile material.

Clause 71. The nursing bra system according to any of clauses 64 through 69, wherein the inner layer of the multi-layer nursing bra is comprised of a first elastically resilient textile material and the outer layer of the multi-layer nursing bra is comprised of a second elastically resilient textile material, and wherein the first elastically resilient textile material has a different modulus of elasticity from the second elastically resilient textile material.

Clause 72. A method for using a nursing bra system, the method comprising: donning the multi-layer nursing bra of any of clauses 64 through 71; and donning the upper-body garment of clauses 64 through 71 over the multi-layer nursing bra, wherein the nursing opening of the upper-body garment is radially aligned with the front portion of the multi-layer nursing bra.

Clause 73. A nursing bra system comprising: a multi-layer nursing bra having: a front portion comprising a first textile layer having a first superior edge, a first inferior edge, a first inner surface, and a first outer surface, and a second textile layer having a second inner surface and a second outer surface, a first superior terminal end, a second superior terminal end, a third inferior terminal end, and a second superior edge extending between the first terminal end and the second terminal end, wherein the second inner surface of the second textile layer faces the first outer surface of the first textile layer; and an underband extending continuously along the first inferior edge of the first textile layer, wherein the third inferior terminal end of the second textile layer is secured to a mid-area of the underband; and an upper-body garment configured to be layered over the multi-layer nursing bra, the upper-body garment comprising: a front aspect and a back aspect defining at least a neck opening, and a waist opening, and a nursing opening extending from a first lateral side of the front aspect to a second lateral side of the front aspect, wherein the nursing opening is positioned below the neck opening.

Clause 74. The nursing bra system according to clause 73, wherein the second textile layer of the multi-layer nursing bra comprises a first side edge extending between the first superior terminal end and the third inferior terminal end, and a second side edge extending between the second superior terminal end and the third inferior terminal end.

Clause 75. The nursing bra system according to clause 74, wherein the first side edge, the second side edge, and the second superior edge of the second textile layer of the multi-layer nursing bra are substantially detached from the first textile layer of the multi-layer nursing bra.

Clause 76. The nursing bra system according to any of clauses 73 through 75, wherein in a first state of the nursing bra system, the first side edge or the second side edge of the second textile layer of the multi-layer nursing bra is positioned inferior to the first superior edge of the first textile layer of the multi-layer nursing bra, and wherein in the first state, the nursing opening of the upper-body garment is in a closed configuration.

Clause 77. The nursing bra system according to any of clauses 74 through 75, wherein in a second state of the nursing bra system, at least a portion of the first side edge or the second side edge of the second textile layer of the multi-layer nursing bra is positioned superior to the first superior edge of the first textile layer of the multi-layer nursing bra to form an opening, and wherein in the second state, the nursing opening of the upper-body garment is in an open configuration.

Clause 78. The nursing bra system according to clause 77, wherein the nursing opening of the upper-body garment is radially aligned with the opening of the multi-layer nursing bra when the nursing bra system is in the second state.

Clause 79. The nursing bra system according to any of clauses 73 through 78, wherein the multi-layer nursing bra further comprises a back portion extending from the first textile layer.

Clause 80. The nursing bra system according to clause 79, wherein the back portion seamlessly extends from the first textile layer of the multi-layer nursing bra.

Clause 81. The nursing bra system according to any of clauses 79 and 80, wherein the multi-layer nursing bra further comprises a pair of shoulder straps extending between the front portion and the back portion.

Clause 82. The nursing bra system according to any of clauses 73 through 78, wherein the multi-layer nursing bra further comprises a first wing band extending from a first lateral side of the first textile layer, and a second wing band extending from a second lateral side of the first textile layer.

Clause 83. The nursing bra system according to clause 82, wherein the first wing band comprises a first element of a closure mechanism, and wherein the second wing band comprises a second element of the closure mechanism, wherein the first element of the closure mechanism is adapted to be releasably coupled to the second element of the closure mechanism.

Clause 84. A nursing bra system comprising: a multi-layer nursing bra comprising a front portion having a first textile layer with a first superior edge, a first inner surface, and a first outer surface, and a second textile layer with a second inner surface positioned adjacent to the first outer surface of the first textile layer, a first superior terminal end, a second superior terminal end, and a third inferior terminal end, a second superior edge extending between the first superior terminal end and the second superior terminal end, a first side edge extending between the first superior terminal end and the third inferior terminal end, and a second side edge extending between the second superior terminal end and the third inferior terminal end, wherein the second superior edge of the second textile layer is positioned superior to the first superior edge of the first textile layer, and wherein the first side edge and the second side edge of the second textile layer are positioned inferior to the first superior edge of the first textile layer in a first state of the nursing bra system, and wherein the first side edge, the second side edge, and the second superior edge of the second textile layer are substantially detached from the first textile layer; and an upper-body garment configured to be layered over the multi-layer nursing bra, the upper-body garment comprising a front aspect and a back aspect defining at least a neck opening, and a waist opening, and a nursing opening extending from a first lateral side of the front aspect to a second lateral side of the front aspect, wherein the nursing opening is positioned below the neck opening, and wherein the nursing opening is in a closed configuration in the first state of the nursing bra system.

Clause 85. The nursing bra system according to clause 84, the multi-layer nursing bra further comprising a back portion extending from the first textile layer of the multi-layer nursing bra.

Clause 86. The nursing bra system according to clause 85, wherein the back portion seamlessly extends from the front portion of the multi-layer nursing bra.

Clause 87. The nursing bra system according to any of clauses 85 through 86, further comprising a pair of shoulder straps for the multi-layer nursing bra, each shoulder strap in the pair of shoulder straps comprising a first strap end and a second strap end, wherein the first strap end of the each shoulder strap is secured to the front portion, and wherein the second strap end of the each shoulder strap is secured to the back portion.

Clause 88. The nursing bra system according to any of clauses 84 through 87, wherein one or more portions of the first outer surface of the first textile layer in the multi-layer nursing bra are not covered by the second textile layer.

Clause 89. The nursing bra system according to clause 84, wherein the multi-layer nursing bra further comprises a first wing band extending from a first lateral side of the first textile layer, and a second wing band extending from a second lateral side of the first textile layer.

Clause 90. The nursing bra system according to clause 89, wherein the first wing band comprises a first element of a closure mechanism, and wherein the second wing band comprises a second element of the closure mechanism, wherein the first element of the closure mechanism is adapted to be releasably coupled to the second element of the closure mechanism.

Clause 91. The nursing bra system according to any of clauses 84 through 90, wherein the nursing opening of the upper-body garment is in an open configuration in a second state of the nursing bra system.

Clause 92. The nursing bra system according to clause 91, wherein at least a portion of the first side edge or the second side edge of the second textile layer is positioned superior to the first superior edge of the first textile layer in the second state of the nursing bra system.

Clause 93. A method for using a nursing bra system, the method comprising: donning the multi-layer nursing bra of any of clauses 84 through 92; and donning the upper-body garment of any of clauses 84 through 92 over the multi-layer nursing bra.

Clause 94. A method for using a nursing bra system comprising: donning a multi-layer nursing bra comprising: a front portion comprising a first textile layer having a first superior edge, a first inferior edge, a first inner surface, a first outer surface, and a second textile layer, a second inner surface, a second outer surface, a first superior terminal end, a second superior terminal end, a third inferior terminal end, and a second superior edge extending between the first superior terminal end and the second superior terminal end, wherein the second inner surface of the second textile layer faces the first outer surface of the first textile layer; and an underband extending continuously along the first inferior edge of the first textile layer, wherein the third inferior terminal end of the second textile layer is secured to a mid-area of the underband; and donning an upper-body garment over the multi-layer nursing bra, the upper-body garment comprising: a front aspect and a back aspect defining at least a neck opening, and a waist opening, and a nursing opening extending from a first lateral side of the front aspect to a second lateral side of the front aspect, wherein the nursing opening is positioned below the neck opening.

Clause 95. The method for using the nursing bra system according to clause 94, wherein the second textile layer of the multi-layer nursing bra comprises a first side edge extending between the first superior terminal end and the third inferior terminal end, and a second side edge extending between the second superior terminal end and the third inferior terminal end.

Clause 96. The method for using the nursing bra system according to clause 95, wherein the first side edge, the second side edge, and the second superior edge of the second textile layer of the multi-layer nursing bra are detached from the first textile layer of the multi-layer nursing bra.

Clause 97. The method for using the nursing bra system according to any of clauses 95 through 96, wherein in a first state of the nursing bra system, the first side edge or the second side edge of the second textile layer of the multi-layer nursing bra is positioned inferior to the first superior edge of the first textile layer of the multi-layer nursing bra, and wherein in the first state, the nursing opening of the upper-body garment is in a closed configuration.

Clause 98. The method for using the nursing bra system according to any of clauses 93 through 96 further comprising: opening the nursing opening of the upper-body garment by exerting an upward force on an upper perimeter edge defining the nursing opening; and exerting a downward force on a lower perimeter edge defining the nursing opening to transition to a second state of the nursing bra system.

Clause 99. The method for using the nursing bra system according to clause 97 further comprising: exerting an upward force on at least a portion of the first side edge or the second side edge of the second textile layer of the multi-layer nursing bra to expose the first superior edge of the first textile layer of the multi-layer nursing bra; and exerting a downward force on the first superior edge of the first textile layer of the multi-layer nursing bra to form a multi-layer nursing bra opening in the second state of the nursing bra system.

Clause 100. The method for using the nursing bra system according to clause 98, further comprising: returning the nursing bra system to the first state by exerting an upward force on the first superior edge of the first textile layer of the multi-layer nursing bra; and exerting a downward force on the portion of the first side edge or the second side edge of the second textile layer of the multi-layer nursing bra to close the multi-layer nursing bra opening.

Clause 101. The method for using the nursing bra system according to clause 99 further comprising: closing the nursing opening of the upper-body garment by exerting a downward force on the upper perimeter edge defining the nursing opening; and exerting an upward force on the lower perimeter edge defining the nursing opening to return the nursing bra system to the first state.

Clause 102. A nursing bra system comprising: a multi-layer nursing bra having a front portion comprising: an inner layer having a right edge extending between an upper right portion and a lower central portion of the inner layer, and a left edge extending between an upper left portion and the lower central portion of the inner layer, wherein the right edge and the left edge converge as they extend toward the lower central portion of the inner layer; and an outer layer adjacent to the inner layer, the outer layer having an upper edge and a lower edge, wherein the upper edge of the outer layer is moveable relative to the inner layer along at least a midpoint of the right edge and along at least a midpoint of the left edge; and an upper-body garment configured to be worn over the multi-layer nursing bra, the upper-body garment comprising: a front portion and a back portion that together define at least a neck opening and a torso opening; and a nursing opening extending from a right side of the front portion toward a left side of the front portion, wherein the nursing opening is positioned below the neck opening and above the torso opening.

Clause 103. The nursing bra system according to clause 102, the outer layer of the multi-layer nursing bra comprising a right-side outer layer and a left-side outer layer, wherein a portion of the right-side outer layer overlaps a portion of the left-side outer layer at a central region of the front portion.

Clause 104. The nursing bra system according to clause 103, wherein the right-side outer layer comprises a right-side upper edge, wherein the left-side outer layer comprises a left-side upper edge, and wherein the right-side upper edge and the left-side upper edge form the upper edge of the outer layer of the multi-layer nursing bra.

Clause 105. The nursing bra system according to any of clauses 103 and 104, wherein the right-side upper edge is movable relative to the inner layer of the multi-layer nursing bra at least at the midpoint of the right edge of the inner layer, and wherein the left-side upper edge is moveable relative to the inner layer of the multi-layer nursing bra at least at the midpoint of the left edge of the inner layer.

Clause 106. The nursing bra system according to any of clauses 102 through 105, the multi-layer nursing bra further comprising a back portion extending from the front portion.

Clause 107. The nursing bra system according to clauses 102 through 106, further comprising a pair of shoulder straps extending between the front portion and the back portion.

Clause 108. The nursing bra system according to any of clauses 102 through 107, the multi-layer nursing bra further comprising a right wing band extending from a right side of the front portion, and a left wing band extending from a left side of the front portion.

Clause 109. The nursing bra system according to clause 108, the multi-layer nursing bra further comprising a first component of a closure mechanism coupled to a terminal end of the right wing band, and a second component of the closure mechanism coupled to a terminal end of the left wing band, wherein the first component of the closure mechanism is releasably coupled to the second component of the closure mechanism.

Clause 110. The nursing bra system according to any of clauses 108 and 109, the multi-layer nursing bra further comprising a first shoulder strap extending between the front portion and the right wing band, and a second shoulder strap extending between the front portion and the left wing band.

Clause 111. The nursing bra system according to any of clauses 102 through 110, wherein the inner layer of the multi-layer nursing bra is substantially Y-shaped.

Clause 112. The nursing bra system according to any of clauses 102 through 111, wherein the right edge and the left edge of the inner layer of the multi-layer nursing bra are curved.

Clause 113. The nursing bra system according to any of clauses 102 through 112, wherein the inner layer of the multi-layer nursing bra is comprised of a first elastically resilient textile material and the outer layer of the multi-layer nursing bra is comprised of a second elastically resilient textile material, and wherein a modulus of elasticity of the first elastically resilient textile material is substantially equal to a modulus of elasticity of the second elastically resilient textile material.

Clause 114. The nursing bra system according to any of clauses 102 through 113, wherein the inner layer of the multi-layer nursing bra is comprised of a first elastically resilient textile material and the outer layer of the multi-layer nursing bra is comprised of a second elastically resilient textile material, and wherein the first elastically resilient textile material has a different modulus of elasticity from the second elastically resilient textile material.

Clause 115. The nursing bra system according to any of clauses 102 through 114, wherein the front portion of the upper-body garment comprises an upper panel and a lower panel.

Clause 116. The nursing bra system according to clause 115, wherein the upper panel of the upper-body garment comprises an upper perimeter edge and wherein the lower panel of the upper-body garment comprises a lower perimeter edge, and wherein the upper perimeter edge and the lower perimeter edge define the nursing opening.

Clause 117. The nursing bra system according to clause 116, wherein the upper perimeter edge of the upper panel is substantially detached from the lower perimeter edge of the lower panel.

Clause 118. The nursing bra system according to any of clause 116 through 117, wherein the upper perimeter edge of the upper panel overlaps the lower perimeter edge of the lower panel when the nursing opening is in a closed state.

Clause 119. A nursing bra system comprising: a multi-layer nursing bra having a front portion comprising: a Y-shaped inner layer having an upper right portion, an upper left portion, and a lower central portion; an outer layer extending between an upper edge and a lower edge, wherein the outer layer is positioned over the Y-shaped inner layer; and an underband extending from the lower edge of the outer layer, wherein the lower central portion of the Y-shaped inner layer is coupled to a central region of the underband; and an upper-body garment configured to be worn over the multi-layer nursing bra, the upper-body garment comprising: a front portion and a back portion that together define at least a neck opening and a torso opening; and a nursing opening extending from a right side of the front portion toward a left side of the front portion, wherein the nursing opening is positioned below the neck opening and above the torso opening.

Clause 120. The nursing bra system according to clause 119, wherein the Y-shaped inner layer of the multi-layer nursing bra further comprises a right edge extending between the upper right portion and the lower central portion, a left edge extending between the upper left portion and the lower central portion, and wherein the Y-shaped inner layer seamlessly and continuously extends between the right edge and the left edge of the Y-shaped inner layer.

Clause 121. The nursing bra system according to clause 120, wherein the nursing opening of the upper-body garment is radially aligned with at least a midpoint of the right edge and a midpoint of the left edge of the Y-shaped inner layer.

Clause 122. The nursing bra system according to any of clauses 120 through 121, wherein when the nursing bra system is in a closed state: the right edge and the left edge of the Y-shaped inner layer are positioned below the upper edge of the outer layer of the multi-layer nursing bra, and the nursing opening of the upper-body garment is closed; and wherein when the nursing bra system is in an open state: at least a portion of the upper edge of the outer layer of the multi-layer nursing bra is positioned below one or more of a midpoint of the right edge and a midpoint of the left edge of the Y-shaped inner layer of the multi-layer nursing bra, and the nursing opening of the upper-body garment is open.

Clause 123. The nursing bra system according to any of clauses 120 through 122, wherein the outer layer of the multi-layer nursing bra is substantially detached from the right edge and the left edge of the Y-shaped inner layer.

Clause 124. The nursing bra system according to any of clauses 120 through 123, the outer layer of the multi-layer nursing bra comprising a right-side outer layer and a left-side outer layer, wherein a portion of the right-side outer layer overlaps a portion of the left-side outer layer at a central region of the front portion.

Clause 125. The nursing bra system according to clause 124, wherein the right-side outer layer comprises a right-side upper edge, wherein the left-side outer layer comprises a left-side upper edge, and wherein the right-side upper edge and the left-side upper edge form the upper edge of the outer layer of the multi-layer nursing bra.

Clause 126. The nursing bra system according to clause 125, wherein the right-side upper edge is movable relative to the Y-shaped inner layer of the multi-layer nursing bra at least at a midpoint of the right edge of the Y-shaped inner layer, and wherein the left-side upper edge is moveable relative to the Y-shaped inner layer of the multi-layer nursing bra at least at a midpoint of the left edge of the Y-shaped inner layer.

Clause 127. The nursing bra system according to any of clauses 119 through 126, wherein the Y-shaped inner layer of the multi-layer nursing bra is comprised of a first elastically resilient textile material and the outer layer of the multi-layer nursing bra is comprised of a second elastically resilient textile material, wherein a modulus of elasticity of the first elastically resilient textile material is substantially equal to a modulus of elasticity of the second elastically resilient textile material.

Clause 128. The nursing bra system according to any of clauses 119 through 127, wherein the Y-shaped inner layer of the multi-layer nursing bra is comprised of a first elastically resilient textile material and the outer layer of the multi-layer nursing bra is comprised of a second elastically resilient textile material, wherein the first elastically resilient textile material has a different modulus of elasticity from the second elastically resilient textile material.

Clause 129. The nursing bra system according to any of clauses 119 through 128, wherein the multi-layer nursing bra further comprises a back portion extending from the front portion.

Clause 130. The nursing bra system according to clause 129, wherein the multi-layer nursing bra further comprises a pair of shoulder straps extending between the front portion and the back portion.

Clause 131. The nursing bra system according to any of clauses 119 through 130, wherein the front portion of the upper-body garment comprises an upper panel and a lower panel.

Clause 132. The nursing bra system according to clause 131, wherein the upper panel of the upper-body garment comprises an upper perimeter edge and wherein the lower panel of the upper-body garment comprises a lower perimeter edge, and wherein the upper perimeter edge and the lower perimeter edge define the nursing opening.

Clause 133. The nursing bra system according to clause 132, wherein the upper perimeter edge of the upper panel is substantially detached from the lower perimeter edge of the lower panel.

Clause 134. The nursing bra system according to any of clauses 132 and 133, wherein the upper perimeter edge of the upper panel overlaps the lower perimeter edge of the lower panel when the nursing opening is in a closed state.

Clause 135. A method for using a nursing bra system, the method comprising: donning the multi-layer nursing bra of any of clauses 102 through 134; and donning the upper-body garment of any of clauses 102 through 134.

Clause 136. A multi-layer nursing bra comprising: a front portion comprising: an inner layer having a right edge extending between an upper right portion and a lower central portion of the inner layer, and a left edge extending between an upper left portion and the lower central portion of the inner layer, wherein the right edge and the left edge converge as they extend toward the lower central portion of the inner layer; and an outer layer adjacent to the inner layer, the outer layer having an upper edge and a lower edge, wherein the upper edge of the outer layer is moveable relative to the inner layer along at least a midpoint of the right edge and along at least a midpoint of the left edge.

Clause 137. The multi-layer nursing bra according to clause 136, wherein the multi-layer nursing bra is layered with an upper-body garment, wherein the upper body garment is configured to be worn over the multi-layer nursing bra, the upper-body garment comprising: a front portion and a back portion that together define at least a neck opening and a torso opening; and a nursing opening extending from a right side of the front portion toward a left side of the front portion, wherein the nursing opening is positioned below the neck opening and above the torso opening.

Clause 138. The multi-layer nursing bra according to clause 137, wherein the front portion of the upper-body garment comprises an upper panel and a lower panel, wherein the upper panel comprises an upper perimeter edge and wherein the lower panel comprises a lower perimeter edge, and wherein the upper perimeter edge and the lower perimeter edge define the nursing opening.

Clause 139. The multi-layer nursing bra according to clause 138, wherein the upper perimeter edge of the upper panel is substantially detached from the lower perimeter edge of the lower panel.

Clause 140. The multi-layer nursing bra according to any of clauses 138 and 139, wherein the upper perimeter edge of the upper panel overlaps the lower perimeter edge of the lower panel when the nursing opening is in a closed state.

Clause 141. The multi-layer nursing bra according to any of clauses 136 through 140, wherein the outer layer of the multi-layer nursing bra comprises a right-side outer layer and a left-side outer layer, wherein a portion of the right-side outer layer overlaps a portion of the left-side outer layer at a central region of the front portion.

Clause 142. The multi-layer nursing bra according to clause 141, wherein the right-side outer layer comprises a right-side upper edge, wherein the left-side outer layer comprises a left-side upper edge, and wherein the right-side upper edge and the left-side upper edge form the upper edge of the outer layer of the multi-layer nursing bra.

Clause 143. The multi-layer nursing bra according to clause 142, wherein the right-side upper edge is movable relative to the inner layer of the multi-layer nursing bra at least at the midpoint of the right edge of the inner layer, and wherein the left-side upper edge is moveable relative to the inner layer of the multi-layer nursing bra at least at the midpoint of the left edge of the inner layer.

Clause 144. The multi-layer nursing bra according to any of clauses 142 and 143, wherein the right-side upper edge and the left-side upper edge are free of stitching on an outer surface of the multi-layer nursing bra.

Clause 145. The multi-layer nursing bra according to any of clauses 136 to 144, further comprising a back portion extending from the front portion.

Clause 146. The multi-layer nursing bra according to clause 154, further comprising a pair of shoulder straps extending between the front portion and the back portion.

Clause 147. The multi-layer nursing bra according to any of clauses 136 through 144, further comprising a right wing band extending from a right side of the front portion, and a left wing band extending from a left side of the front portion.

Clause 148. The multi-layer nursing bra according to clause 147, further comprising a first component of a closure mechanism coupled to a terminal end of the right wing band, and a second component of the closure mechanism coupled to a terminal end of the left wing band, wherein the first component of the closure mechanism is releasably coupled to the second component of the closure mechanism.

Clause 149. The multi-layer nursing bra according to any of clauses 147 and 148, further comprising a first shoulder strap extending between the front portion and the right wing band, and a second shoulder strap extending between the front portion and the left wing band.

Clause 150. The multi-layer nursing bra according to any of clauses 136 through 149, wherein the inner layer is substantially Y-shaped.

Clause 151. The multi-layer nursing bra according to any of clauses 136 through 150, wherein the right edge and the left edge are curved.

Clause 152. The multi-layer nursing bra of according to any of clauses 136 through 151, wherein the inner layer is comprised of a first elastically resilient textile material and the outer layer is comprised of a second elastically resilient textile material, and wherein a modulus of elasticity of the first elastically resilient textile material is substantially equal to a modulus of elasticity of the second elastically resilient textile material.

Clause 153. The multi-layer nursing bra according to any of clauses 136 through 152, wherein the inner layer is comprised of a first elastically resilient textile material and the outer layer is comprised of a second elastically resilient textile material, and wherein the first elastically resilient textile material has a different modulus of elasticity from the second elastically resilient textile material.

Clause 154. The multi-layer nursing bra according to any of clauses 136 through 153, wherein the inner layer is comprised of a single layer of material.

Clause 155. A multi-layer nursing bra comprising: a front portion having: a Y-shaped inner layer having an upper right portion, an upper left portion, and a lower central portion; an outer layer extending between an upper edge and a lower edge, wherein the outer layer is positioned over the Y-shaped inner layer; and an underband extending from the lower edge of the outer layer, wherein the lower central portion of the Y-shaped inner layer is coupled to a central region of the underband.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A multi-layer nursing bra comprising:

a front portion having:

an inner layer having a first inner surface and a first outer surface; and an outer layer having a second inner surface and a second outer surface, wherein the second inner surface of the outer layer is positioned adjacent to the first outer surface of the inner layer, the outer layer further having a right edge extending between an upper right portion and a lower central portion of the outer layer, and a left edge extending between an upper left portion and the lower central portion of the outer layer, wherein the right edge and the left edge converge as they extend toward the lower central portion of the outer layer, and wherein the right edge and the left edge of the outer layer are detached from the inner layer.

2. The multi-layer nursing bra according to claim 1, wherein the outer layer is substantially Y-shaped.

3. The multi-layer nursing bra according to claim 1, wherein the right edge and the left edge of the outer layer are curved.

4. The multi-layer nursing bra according to claim 1, wherein the inner layer is comprised of a first elastically resilient textile material and the outer layer is comprised of a second elastically resilient textile material.

5. The multi-layer nursing bra according to claim 4, wherein a first modulus of elasticity of the first elastically resilient textile material is substantially equal to a second modulus of elasticity of the second elastically resilient textile material.

6. The multi-layer nursing bra according to claim 4, wherein a first modulus of elasticity of the first elastically resilient textile material is different from a second modulus of elasticity of the second elastically resilient textile material.

7. The multi-layer nursing bra according to claim 1, wherein the outer layer is seamlessly seamless and continuously extends between the right edge and the left edge.

8. The multi-layer nursing bra according to claim 1, wherein a first superior edge of the inner layer is moveable relative to the outer layer.

9. The multi-layer nursing bra according to claim 8, further comprising a second superior edge extending between the upper right portion and the upper left portion, wherein the second superior edge of the outer layer is positioned above the first superior edge of the inner layer.

10. The multi-layer nursing bra according to claim 1, wherein one or more portions of the inner layer are not covered by the outer layer.

11. The multi-layer nursing bra according to claim 1, further comprising an underband, wherein the lower central portion of the outer layer and an inferior edge of the inner layer are affixed to the underband.

12. A multi-layer nursing bra comprising:

an underband; and a front portion having:

an inner layer having a first inner surface, a first outer surface, a first inferior edge and a first superior edge; and an outer layer having a second inner surface, a second outer surface, a first superior terminal end, a second superior terminal end, and a third inferior terminal end, wherein a second superior edge of the outer layer extends between the first superior terminal end and the second superior terminal end, wherein the second inner surface of the outer layer is positioned adjacent to the first outer surface of the inner layer, wherein the first inferior edge of the inner layer and the third inferior terminal end of the outer layer are secured to the underband of the multi-layer nursing bra.

13. The multi-layer nursing bra according to claim 12, further comprising a back portion and a pair of shoulder straps.

14. The multi-layer nursing bra according to claim 12, wherein the outer layer further comprises a first edge extending between the first superior terminal end and the third inferior terminal end; and a second edge extending between the second superior terminal end and the third inferior terminal end, wherein the first edge and the second edge converge towards one another as they extend toward the third inferior terminal end.

15. The multi-layer nursing bra according to claim 14, wherein the second superior edge, the first edge and the second edge of the outer layer are detached from the inner layer.

16. The multi-layer nursing bra according to claim 14, wherein in a first state, the first edge and the second edge of the outer layer are positioned inferior to the first superior edge of the inner layer, when the multi-layer nursing bra is in an as-worn configuration.

17. The multi-layer nursing bra according to claim 14, wherein in a second state, at least a portion of the first superior edge of the inner layer is positioned inferior to the first edge or the second edge of the outer layer, when the multi-layer nursing bra is in an as-worn configuration.

18. A multi-layer nursing bra according to claim 12, wherein the multi-layer nursing bra is configured to be worn with an upper body garment comprising a nursing opening.

19. The multi-layer nursing bra according to claim 12, wherein the inner layer is comprised of a first elastically resilient textile material and the outer layer is comprised of a second elastically resilient textile material.

20. A method for manufacturing a multi-layer nursing bra, the method comprising:

constructing a front portion of the multi-layer nursing bra by positioning an outer surface of an inner layer adjacent to an inner surface of an outer layer, wherein the inner layer comprises a first superior edge and a first inferior edge, wherein the outer layer comprises a first superior terminal end, a second superior terminal end, a third inferior terminal end, and a second superior edge extending between the first superior terminal end and the second superior terminal end;

affixing an underband along a length of the first inferior edge of the inner layer; and affixing the third inferior terminal end of the outer layer to a central area of the underband.

* * * * *